US010770018B2

(12) United States Patent
Kusumi et al.

(10) Patent No.: US 10,770,018 B2
(45) Date of Patent: Sep. 8, 2020

(54) SCANNING SIGNAL LINE DRIVE CIRCUIT, DISPLAY DEVICE INCLUDING THE SAME, AND SCANNING SIGNAL LINE DRIVING METHOD

(71) Applicant: Sharp Kabushiki Kaisha, Sakai, Osaka (JP)

(72) Inventors: Takatsugu Kusumi, Sakai (JP); Takuya Watanabe, Sakai (JP); Akira Tagawa, Sakai (JP); Yasuaki Iwase, Sakai (JP); Yohei Takeuchi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/291,049

(22) Filed: Mar. 4, 2019

(65) Prior Publication Data

US 2019/0279589 A1 Sep. 12, 2019

(30) Foreign Application Priority Data

Mar. 6, 2018 (JP) ..... 2018-039421

(51) Int. Cl.
*G09G 3/36* (2006.01)

(52) U.S. Cl.
CPC ..... *G09G 3/3677* (2013.01); *G09G 3/3688* (2013.01); *G09G 3/3696* (2013.01); *G09G 2310/0286* (2013.01); *G09G 2310/08* (2013.01); *G09G 2330/021* (2013.01)

(58) Field of Classification Search
None
See application file for complete search history.

(56) References Cited

U.S. PATENT DOCUMENTS 5,206,634 A * 4/1993 Matsumoto ..... G09G 3/3648 345/99
2013/0093743 A1 4/2013 Takahashi et al.
2014/0092082 A1 4/2014 Choi

FOREIGN PATENT DOCUMENTS

JP 2013-214088 A 10/2013
JP 2014-71451 A 4/2014

* cited by examiner

*Primary Examiner* — Matthew Yeung
(74) *Attorney, Agent, or Firm* — Keating & Bennett, LLP

(57) ABSTRACT

The present application discloses a scanning signal line drive circuit capable of reducing power consumption and narrowing a picture-frame while ensuring high-speed scanning for image display. First and second gate drivers 410, 420 are arranged to face each other via a display unit 500. Based on a DC buffer method, odd-numbered gate lines are driven by the first gate driver 410 while even-numbered gate bus lines are driven by the second gate driver 420, and when each gate bus line GLi is to be brought into a non-selected state, charges are released from both ends thereof. For this purpose, for example, the end portion of the odd-numbered gate bus line on the first gate driver side is connected to a buffer made up of the activation and inactivation transistors M10, M13L, and the end portion of the odd-numbered gate bus line on the second gate driver side is connected to the inactivation auxiliary transistor M13R.

8 Claims, 9 Drawing Sheets

Two-Sided Input Method

One-Sided Input Method

SCANNING SIGNAL LINE DRIVE CIRCUIT, DISPLAY DEVICE INCLUDING THE SAME, AND SCANNING SIGNAL LINE DRIVING METHOD

BACKGROUND OF THE INVENTION

(1) Field of the Invention

The present invention relates to a display device, and more particularly relates to a scanning signal line drive circuit and a driving method for driving a scanning signal line provided in a display unit of a display device.

(2) Description of Related Art

Conventionally, there is known a matrix type display device provided with a plurality of data signal lines (also referred to as "source bus lines"), a plurality of scanning signal lines (also referred to as "gate bus lines") intersecting the plurality of data signal lines, and a display unit including a plurality of pixel formation portions arranged in a matrix along the plurality of scanning signal lines. Such a matrix type display device includes a data signal line drive circuit (also referred to as "data driver" or "source driver") for driving the plurality of data signal lines, and a scanning signal line drive circuit (also referred to as "gate driver") for driving the plurality of scanning signal lines. The scanning signal line drive circuit applies a plurality of scanning signals to the plurality of scanning signal lines so that the plurality of scanning signal lines are sequentially selected in each frame period, and the data signal line drive circuit applies to the plurality of data signal lines a plurality of data signals representing an image to be displayed in conjunction with the sequential selection of the plurality of scanning signal lines. Thus, a plurality of pieces of pixel data constituting image data representing an image to be displayed are provided to each of the plurality of pixel formation portions.

Meanwhile, in an active matrix-type liquid crystal display device, the scanning signal line drive circuit has often been mounted as an integrated circuit (IC) chip in a peripheral portion of a substrate constituting a liquid crystal panel as a display panel including a display unit as described above. However, in recent years, the scanning signal line drive circuits have been increasingly formed directly on the substrate. Such a scanning signal line drive circuit is called a "monolithic gate driver" or the like, and a display panel including such a scanning signal line drive circuit is called a "gate driver monolithic panel" or a "GDM panel."

With regard to such a monolithic gate driver or GMD panel, various conventional techniques are known. For example, as shown in FIG. 7, there is conventionally known a gate driver including an output unit configured such that a gate clock signal GCKk is applied as a scanning signal G(n) to a gate bus line via a transistor M10 as an output switching element. Further, as shown in FIG. 9, there is also known a gate driver including an output unit in which the gate bus line to which the scanning signal G(n) is to be applied is connected to a high-voltage power-supply line VDD1 via the transistor M10 as an activation switching element, and is connected to a low-voltage power-supply line VSS via a transistor M13L as a inactivation switching element (e.g., see Japanese Unexamined Patent Application Publication No. 2013-214088). In this configuration, when the gate bus line is to be brought into the selected state, the transistor M10 is turned on and a high-voltage power-supply voltage (fixed voltage) is applied to the gate bus line, and when the gate bus line is to be brought into a non-selected state, the transistor M13L is turned on and a low-voltage power-supply voltage (fixed voltage) is applied to the gate bus line. Further, as shown in FIGS. 11A and 11B, there is also a monolithic gate driver made up of first and second gate drivers that face each other via a display unit. As a method to provide a scanning signal from the gate driver to the gate bus line in such a configuration, other than a two-sided input method of applying scanning signals to both ends of each gate bus line as shown in FIG. 11A, there is known a one-sided input method of alternately applying scanning signals to one end and the other end of the gate bus line in the display unit (e.g., a method of applying a scanning signal from the first gate driver to an odd-numbered gate bus line, and applying a scanning signal from the second gate driver to an even-numbered gate bus line) as shown in FIG. 11B (e.g., see Japanese Laid-Open Patent Publication No. 2014-071451).

In order to reduce power consumption in the monolithic gate driver as described above, it is conceivable to increase the number of phases of the gate clock signal. This is because when the number of phases of the gate clock signal is increased, the number of buffer transistors connected to one signal line for supplying the gate clock signal is reduced, and a load of a transistor that performs charging and discharging is thus reduced. However, when the number of phases of the gate clock signal is increased, a picture-frame region in the display panel is increased.

SUMMARY OF THE INVENTION

It is thus desirable to provide a scanning signal line drive circuit such as a monolithic gate driver capable of reducing the power consumption while preventing an increase in picture-frame region of a display panel, and provide a display device including the above scanning signal line drive circuit.

Several embodiments of the present invention are scanning signal line drive circuits each for selectively driving a plurality of scanning signal lines provided on a display unit of a display device, the scanning signal line drive circuit including: a first scanning signal line drive unit disposed on one end side of the plurality of scanning signal lines; a second scanning signal line drive unit disposed on the other end side of the plurality of scanning signal lines; a first power supply line configured to supply a fixed voltage to be applied to a scanning signal line to be brought into a selected state; and a second power supply line configured to supply a fixed voltage to be applied to the scanning signal line to be brought into a non-selected state. The first scanning signal line drive unit includes a first activation switching element that is provided for each of odd-numbered scanning signal lines in the plurality of scanning signal lines, is an on-state while the scanning signal line is to be in a selected state, and is in an off-state while the scanning signal line is to be in a non-selected state, a first inactivation switching element that is provided for each of the odd-numbered scanning signal lines in the plurality of scanning signal lines, is in the off-state while the scanning signal line is to be in the selected state, and is in the on-state while the scanning signal line is to be in the non-selected state, and a first inactivation auxiliary switching element that is provided for each of even-numbered scanning signal lines in the plurality of scanning signal lines, is in the off-state while the scanning signal line is to be in the selected state, and is in the on-state while the scanning signal line is to be in the non-selected state. The second scanning signal line drive unit includes a second activation switching element that is provided for each of the even-numbered scanning signal lines in the plurality of scanning signal lines, is in the on-state while the scanning signal line is to be in the selected state, and is in the off-state while the scanning signal line is to be in the non-selected state, a second inactivation switching element that is provided for each of the even-numbered scanning signal lines in the plurality of scanning signal lines, is in the off-state while the scanning signal line is to be in the selected state, and is in the on-state while the scanning signal line is to be in the non-selected state, and a second inactivation auxiliary switching element that is provided for each of odd-numbered scanning signal lines in the plurality of scanning signal lines, is in the off-state while the scanning signal line is to be in the selected state, and is in the on-state while the scanning signal line is to be in the non-selected state. Each of the odd-numbered scanning signal lines in the plurality of scanning signal lines is connected to the first power supply line via the first activation switching element, is connected to the second power supply line via the first inactivation switching element, and is connected to the second power supply line via the second inactivation auxiliary switching element. Each of the even-numbered scanning signal lines in the plurality of scanning signal lines is connected to the first power supply line via the second activation switching element, is connected to the second power supply line via the second inactivation switching element, and is connected to the second power supply line via the first inactivation auxiliary switching element.

According to the several embodiments of the present invention, on one end side of the plurality of scanning signal lines in the display unit, each of the odd-numbered scanning signal lines out of the plurality of scanning signal lines is connected to the first power supply line that supplies a fixed voltage to be applied to the scanning signal line to be brought into a selected state, namely a selection voltage, while the scanning signal line is to be in the selected state. On the other end side of the plurality of scanning signal lines in the display unit, each of the even-numbered scanning signal lines out of the plurality of scanning signal lines is connected to the first power supply line while the scanning signal line is to be in the selected state. On the other hand, on the one end side, each of the odd-numbered scanning signal lines out of the plurality of scanning signal lines is connected to the second power supply line that supplies a fixed voltage to be applied to the scanning signal line to be brought into a non-selected state, namely a non-selection voltage, while the scanning signal line is to be in the non-selected state, and also on the other end side, each of the odd-numbered scanning signal lines is connected to the second power supply line. Further, each of the even-numbered scanning signal lines out of the plurality of scanning signal lines is connected to the second power supply line on the other end side and is connected to the second power supply line also on the one end side while the scanning signal line is to be in the non-selected state. In this manner, while each of the scanning signal lines in the display unit is to be in the selected state, the fixed voltage as the selection voltage is applied to the scanning signal line by connection of either the one end side or the other end side to the first power supply line, so that it is possible to reduce a picture-frame region in the display panel while reducing the power consumption for driving the plurality of scanning signal lines. When each of the plurality of scanning signal lines in the display unit is to be brought into the non-selected state, the fixed voltage as a non-selection voltage is applied to the scanning signal line by connection of both the one end side and the other end side to the second power supply line, whereby it is possible to reduce blunting of the waveform of the scanning signal at the time of changing from the selected state to the non-selected state while preventing an increase in the picture-frame region (to shorten the time required for transition from the selected state to the non-selected state). Therefore, according to the several embodiments of the present invention, it is possible to reduce power consumption and narrow a picture-frame while ensuring high-speed scanning capacity for image display in the scanning signal line drive circuit.

Another several embodiments of the present invention are driving methods each for selectively driving a plurality of scanning signal lines provided on a display unit of a display device, the driving method including: a first scanning signal line driving step of driving the plurality of scanning signal lines on one end side of the plurality of scanning signal lines; and a second scanning signal line driving step of driving the plurality of scanning signal lines on the other end side of the plurality of scanning signal lines. The first scanning signal line driving step includes a step of connecting each of odd-numbered scanning signal lines in the plurality of scanning signal lines to a first power supply line that supplies a fixed voltage to be applied to a scanning signal line to be brought into a selected state while the scanning signal line is to be in the selected state, a step of connecting each of the odd-numbered scanning signal lines in the plurality of scanning signal lines to a second power supply line that supplies a fixed voltage to be applied to a scanning signal line to be brought into a non-selected state when the scanning signal line is to be brought into the non-selected state, and a step of connecting each of even-numbered scanning signal lines in the plurality of scanning signal lines to the second power supply line when the scanning signal line is to be brought into the non-selected state. The second scanning signal line driving step includes a step of connecting each of the even-numbered scanning signal lines in the plurality of scanning signal lines to the first power supply line while the scanning signal line is to be in the selected state, a step of connecting each of the even-numbered scanning signal lines in the plurality of scanning signal lines to the second power supply line when the scanning signal line is to be brought into the non-selected state, and a step of connecting each of the odd-numbered scanning signal lines in the plurality of scanning signal lines to the second power supply line when the scanning signal line is to be brought into the non-selected state.

These and other objects, features, modes, and advantages of the present invention will become more apparent from the following detailed description of the present invention with reference to the accompanying drawings.

DESCRIPTION OF THE EMBODIMENTS

One embodiment of the present invention will be described below with reference to the accompanying drawings. In each of transistors mentioned below, a gate terminal corresponds to a control terminal, one of a drain terminal and a source terminal corresponds to a first conduction terminal, and the other corresponds to the second conduction terminal. In addition, all of the transistors in the present embodiment are assumed to be N-channel type, but the present invention is not limited to this. In the N-channel transistor, a conduction terminal with a higher potential out of the two conduction terminals is the drain terminal and a conduction terminal with a lower potential is the source terminal. However, in the present specification, even when the potential levels of the two conduction terminals are reversed during the operation, one of the two conduction terminals is fixedly referred to as a "drain terminal" and the other is referred to as a "source terminal." In addition, "connection" in the present specification means "electrical connection" unless otherwise specified, and may not only mean direct connection, but also mean indirect connection via another element, in the scope not deviating from the gist of the present invention.

1.1 Overall Configuration and Operation Overview

Figure 1:
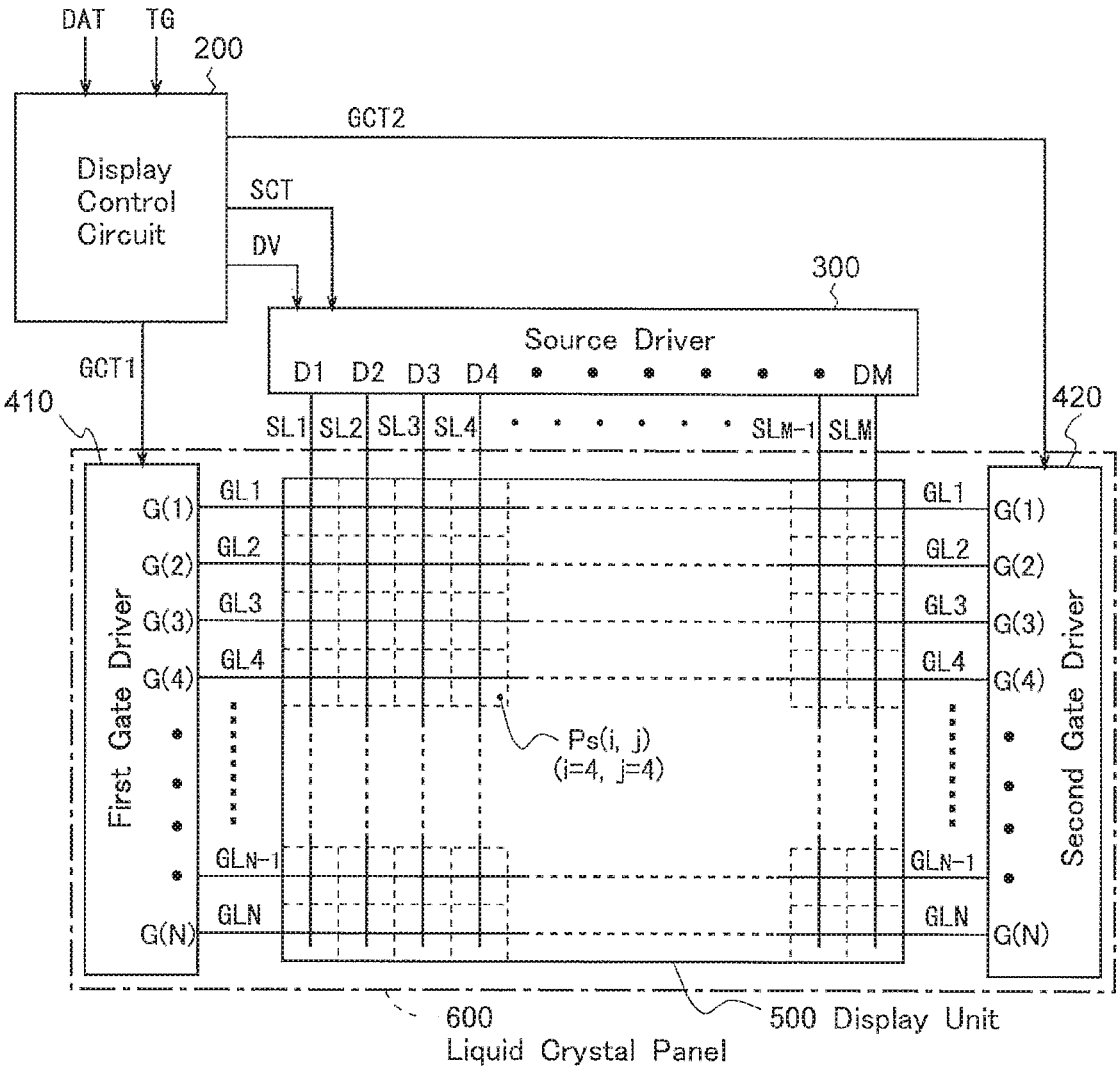
FIG. 1 is a block diagram showing an overall configuration of an active matrix-type display device according to an embodiment.

FIG. 1 is a block diagram showing an overall configuration of an active matrix-type liquid crystal display device according to the present embodiment. This liquid crystal display device is provided with a display control circuit 200, a source driver 300 as a data signal line drive circuit, and a liquid crystal panel 600 including a display unit 500 and a gate driver as a scanning signal line drive circuit. In the present embodiment, a pixel circuit constituting the display unit 500 and a gate driver are integrally formed on one of two substrates (referred to as "TFT substrate") constituting the liquid crystal panel 600, and as shown in FIG. 1, the gate driver is made up of first and second gate drivers 410, 420 arranged to face each other via a display unit 500.

The display unit 500 is provided with source bus lines SL1 to SLM as a plurality of (M) data signal lines, gate bus lines GL1 to GLN as a plurality of (N) scanning signal lines intersecting the plurality of source bus lines SL1 to SLM, and a plurality of (M×N) pixel formation portions Ps(i, j) (i=1 to N, j=1 to M) arranged in a matrix along the plurality of source bus lines SL1 to SLM and the plurality of gate bus lines GL1 to GLN. Each pixel formation portion Ps(i, j) corresponds to one of the plurality of source bus lines SL1 to SLM and corresponds to one of the plurality of gate bus lines GL1 to GLN. Note that the mode of the liquid crystal panel 600 is not limited to a vertical alignment (VA) mode, a twisted nematic (TN) mode, or the like in which an electric field is applied in a direction perpendicular to the liquid crystal layer, but may be an in-plane switching (IPS) mode in which an electric field is applied in a direction substantially parallel to the liquid crystal layer.

Figure 2:
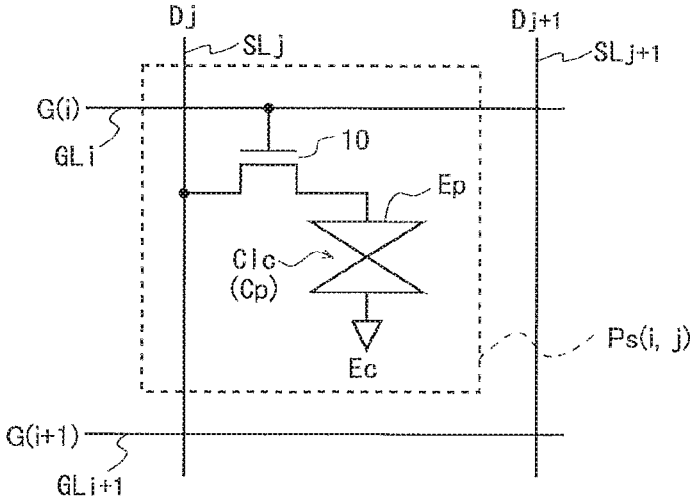
FIG. 2 is a circuit diagram showing an electrical configuration of a pixel formation portion in the embodiment.

FIG. 2 is a circuit diagram showing an electrical configuration of one pixel formation portion Ps(i, j) in the display unit 500. As shown in FIG. 2, each pixel formation portion includes: an N-channel thin film transistor (TFT) 10 as a pixel switching element that has a gate terminal connected to a gate bus line GLi passing through a corresponding intersection, and has a source terminal connected to a source bus line SLj passing through the intersection; a pixel electrode Ep connected to a drain terminal of the thin film transistor M10; a common electrode Ec being a counter electrode provided so as to be shared by the plurality of pixel formation portions Ps(i, j) (i=1 to N, j=1 to M); and a liquid crystal layer provided so as to be shared by the plurality of pixel formation portions Ps(i, j) (i=1 to N, j=1 to M), and sandwiched between the pixel electrode Ep and the common electrode Ec. A liquid crystal capacitance Clc formed of the pixel electrode Ep and the common electrode Ec constitutes a pixel capacitance Cp. Note that an auxiliary capacitance is normally provided in parallel with the liquid crystal capacitance Clc so as to reliably hold a charge in the pixel capacitance Cp, but the auxiliary capacitance is not directly related to the present invention, and hence the description and illustration thereof are omitted. When the liquid crystal panel 600 is of the IPS mode, the common electrode Ec is formed on the one substrate (TFT substrate) out of the two substrates constituting the liquid crystal panel 600, to constitute the pixel circuit together with the thin film transistor 10 and the pixel electrode Ep. However, when the liquid crystal panel 600 is of the VA mode or the like, the common electrode Ec is formed on the other of the two substrates.

As the thin film transistor 10 in the pixel formation portion Ps(i, j), a thin film transistor (a-Si TFT) using amorphous silicon for a channel layer, a thin film transistor using microcrystalline silicon for a channel layer, a thin film transistor using an oxide semiconductor for a channel layer (oxide TFT), a thin film transistor (LTPS-TFT) using low-temperature polysilicon for the channel layer, or the like can be adopted. As the oxide TFT, for example, a thin film transistor having an oxide semiconductor layer containing an In—Ga—Zn—O-based semiconductor (e.g., indium gallium zinc oxide) can be adopted. Regarding these points, the same applies to the thin film transistors in the first and second gate drivers 410, 420.

The display control circuit 200 receives an image signal DAT and a timing control signal TG applied from the outside, and outputs a digital video signal DV, a data-side control signal SCT for controlling the operation of the source driver 300, and first and second scanning-side control signals GCT1, GCT2 for controlling the first and second gate drivers 410, 420, respectively. The data-side control signal SCT includes a start pulse signal, a source clock signal, a latch strobe signal, and the like. The first scanning-side control signal GCT1 includes a first gate start pulse signal GSP1, first, third, and fifth gate clock signals GCK1, GCK3, GCK5, and the like, and the second scanning-side control signal GCT2 includes a second gate start pulse signal GSP2, second, fourth, and sixth gate clock signals GCK2, GCK4, GCK6, and the like. In the present embodiment, the gate driver made up of the first and second gate drivers 410, 420 operates by a six-phase clock signal made up of the first to sixth gate clock signals GCK1 to GCK6.

The source driver 300 applies data signals D1 to DM to the source bus lines SL1 to SLM based on the digital video signal DV and the data-side control signal SCT from the display control circuit 200. At this time, the source driver 300 sequentially holds the digital video signal DV representing a voltage to be applied to each source bus line SL at timing when a pulse of the source clock signal occurs. Then, the held digital video signal DV is converted into an analog voltage at timing when a pulse of the latch strobe signal occurs. The converted analog voltages are simultaneously applied to all source bus lines SL1 to SLM as the data signals D1 to DM.

The first gate driver 410 is disposed on one end side of the gate bus lines GL1 to GLN and applies odd-numbered scanning signals G(1), G(3), G(5), . . . to the odd-numbered gate bus lines GL1, GL3, GL5, . . . respectively, based on the first scanning-side control signal GCT1 from the display control circuit 200, and the second gate driver 420 is disposed on the other end side of the gate bus lines GL1 to GLN and applies even-numbered scanning signals G(2), G(4), G(6), . . . to the even-numbered gate bus lines GL2, GL4, GL6, . . . respectively, based on the second scanning-side control signal GCT2 from the display control circuit 200. As a result, active scanning signals are sequentially applied to the gate bus lines GL1 to GLN in each frame period, and application of active scanning signals to the respective gate bus lines GL1*i* (i=1 to N) is repeated using one frame period as a cycle.

A backlight unit (not shown) is provided on the back surface side of the liquid crystal panel 600, and hence the back surface of the liquid crystal panel 600 is irradiated with back light. This backlight unit is also driven by the display control circuit 200, but may be configured to be driven by other methods. When the liquid crystal panel 600 is a reflective type, the backlight unit is unnecessary.

As described above, the data signals D1 to DM are applied to the source bus lines SL1 to SLM, and the scanning signals G(1) to G(N) are applied to the gate bus lines GL1 to GLN. A predetermined common voltage Vcom is supplied from a power supply circuit (not shown) to the common electrode Ec. Further, the backlight unit is supplied with a signal for driving the backlight. By driving of the source bus lines SL1 to SLM, the gate bus lines GL1 to GLN, and the common electrode Ec in the display unit 500 as described above, pixel data based on the digital video signal DV is written into each pixel formation portion Ps(i, j), and at the same time, by irradiation of the back surface of the liquid crystal panel 600 with light from the backlight unit, an image represented by the image signal DAT applied from the outside is displayed on the display unit 500.

2. Gate Driver

Next, the gate driver in the present embodiment will be described in detail. In the present embodiment, all the transistors constituting the gate driver are N-channel thin film transistors.

2.1 Basic Configuration of Gate Driver

Figure 3:
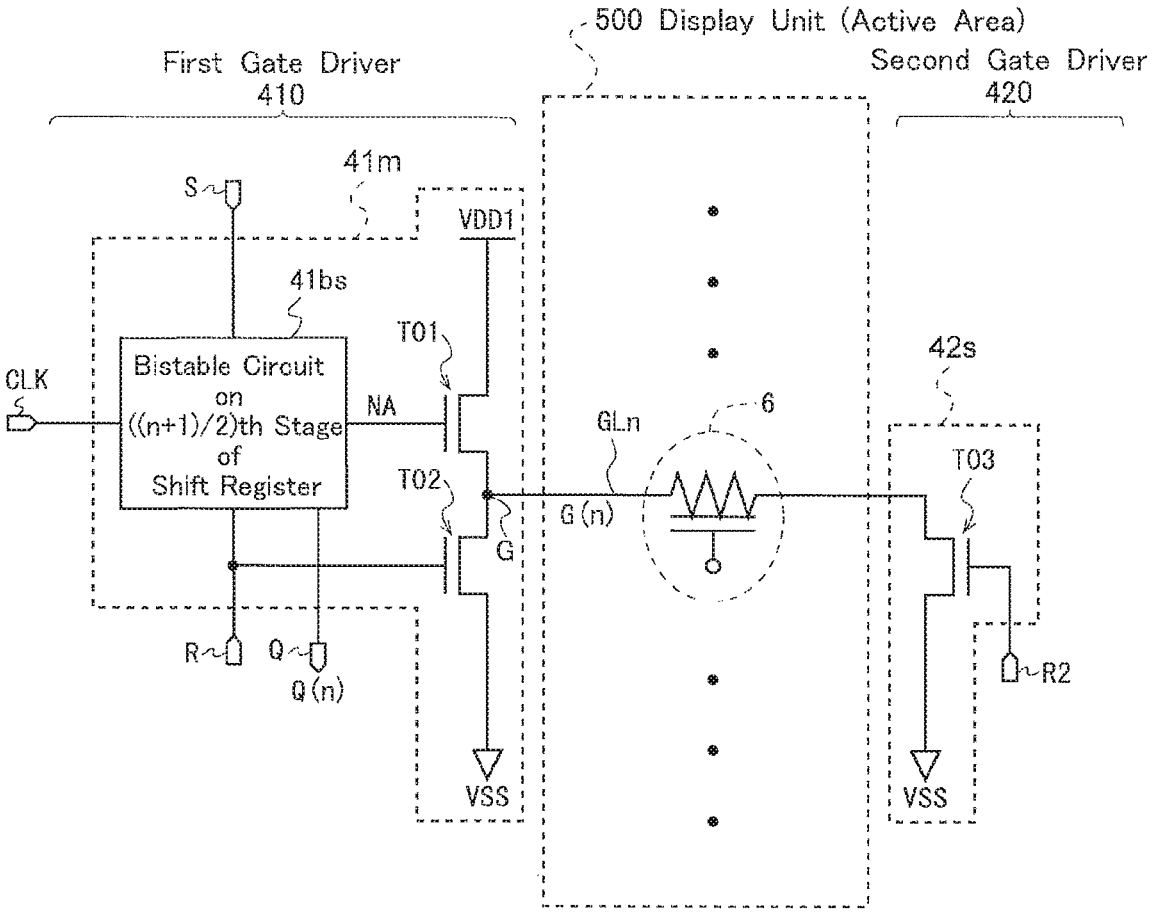
FIG. 3 is a circuit diagram for describing a basic configuration of a gate driver in the embodiment.

FIG. 3 is a circuit diagram for explaining the basic configuration of the gate driver in the present embodiment, and shows a configuration of a portion of the gate driver which drives the nth gate bus line GLn (here, n is an odd number). Assuming that the number N of the gate bus lines GL1 to GLN in the display unit 500 is an even number, each of the first and second gate drivers 410, 420 includes N/2 bistable circuits that are cascade-connected to each other to form N/2-staged shift register. As shown in FIG. 3, the portion of the gate driver which drives the nth gate bus line GLn includes; a bistable circuit 41*bs* on a ((n+1)/2)th stage of the shift register, a transistor (hereinafter referred to as "activation transistor") T01 as an activation switching element, and a transistor (hereinafter referred to as "inactivation transistor") T02 as an inactivation switching element, which are included in the first gate driver 410; and a transistor (hereinafter referred to as "inactivation auxiliary transistor") T03 as an inactivation auxiliary switching element included in the second gate driver 420.

Each bistable circuit in the shift register is a reset-set (RS) flip-flop, and in the bistable circuit 41*bs* shown in FIG. 3, an output signal Q of a preceding bistable circuit is input into a set terminal S, an output signal Q of the subsequent bistable circuit is input into a reset terminal R, and any one of the first, third, and fifth gate clock signals is input into a clock terminal CLK (details will be described later). The activation transistor T01 has a gate terminal connected to a signal NA of the bistable circuit 41*bs*, a drain terminal connected to a first high-voltage power-supply line VDD1, and a source terminal connected to a drain terminal of the inactivation transistor T02. The inactivation transistor T02 has a gate terminal connected to the reset terminal R of the bistable circuit 41*bs*, and a source terminal connected to a low-voltage power-supply line VSS. A connection point (G) between the source terminal of the activation transistor T01 and the drain terminal of the inactivation transistor T02 is connected to one end of the nth gate bus line GLn to be driven. Meanwhile, the inactivation auxiliary transistor T03 included in the second gate driver 420 has a gate terminal connected to an output terminal of another predetermined bistable circuit in the second gate driver 420, a drain terminal connected to the other end of the nth gate bus line GLn, and a source terminal connected to the low-voltage power-supply line VSS. The first high-voltage power-supply line VDD1 corresponds to the first power supply line disposed in the gate driver so as to supply a fixed voltage (hereinafter referred to as "selection voltage" and also denoted by symbol "VDD1") to be applied to the gate bus line SLi to be brought into a selected state. The low-voltage power-supply line VSS corresponds to the second power supply line disposed in the gate driver so as to supply a fixed voltage (hereinafter referred to as "non-selection voltage" and also denoted by symbol "VSS") to be applied to the gate bus line SLi to be brought into a non-selected state. In addition, the gate bus line GLi includes wiring resistance and a wiring capacitance, they are shown as a gate load 6 in FIG. 3 (the same applies to FIG. 10 to be described later).

The gate driver having such a configuration as above operates based on a gate clock signal (any one of the first to sixth gate clock signals GCK1 to GCK6) that is applied to the clock terminal CLK of each bistable circuit, and while the odd-numbered gate bus lines GLn in the display unit 500 is to be in the selected state, in the first gate driver 410, the output signal Q of the bistable circuit 41*bs* corresponding to the gate bus line GLn is active (at a high level (H level) in the present embodiment), and the activation transistor T01 is in an on-state. Therefore, during this time, the selection voltage VDD1 is applied to the gate bus line GLn via the activation transistor T01. When the gate bus line GLn is to be brought into the non-selected state, the signal (the output signal of the subsequent bistable circuit) that is applied to the reset terminal R of the corresponding bistable circuit 41*bs* shifts to the H level and the inactivation transistor T02 is turned on, so that the non-selection voltage VSS is applied to the gate bus line GLn via the inactivation transistor T02. At this time, in the second gate driver 420, an H-level signal being an output signal of another predetermined bistable circuit is applied to the gate terminal (R2) of the inactivation auxiliary transistor T03 corresponding to the gate bus line GLn, and the inactivation auxiliary transistor T03 is also turned on, and the non-selection voltage VSS is applied to the gate bus line GLn also through the inactivation auxiliary transistor T03 (details will be described later). Therefore, when the gate bus line GLn is to be brought into the non-selected state, charges (charges accumulated in the wiring capacitance) in the gate bus line GLn are released from both the one end side and the other end side of the gate bus line GLn.

Assuming that the circuit made up of the constituent elements (the bistable circuit 41*bs*, the activation transistor T01, and the inactive transistor T02) of the first gate driver 410 shown in FIG. 3 is referred to as a "unit main circuit 41*m* on the first gate driver side" and the circuit made up of the constituent element (the inactivation auxiliary transistor T03) of the second gate driver 420 shown in FIG. 3 is referred to as a "unit sub-circuit 42*s* on the second gate driver side", in the present embodiment a portion (not shown) of the gate driver which drives an even-numbered gate bus lines GLn+1 (n is an odd number) has a configuration by replacement between the unit main circuit 41*m* on the first gate driver side and the unit sub-circuit 42*s* on the second gate driver side. That is, the portion for driving the gate bus line GLn+1 is made up of: a circuit (hereinafter referred to as a "unit main circuit 42*m* on the second gate driver side") having the same configuration as that of the unit main circuit 41*m* on the first gate driver side, and connected to the end portion (the other end) on the second gate driver side of the gate bus line GLn+1; and a circuit (hereinafter referred to as a "unit sub-circuit 41*s* on the first gate driver side") having the same configuration as that of the unit sub-circuit 42*s* on the second gate driver side, and connected to the end portion (one end) on the first gate driver side of the gate bus line GLn+1. In the following description, the unit main circuit 41*m* and the unit sub-circuit 41*s* on the first gate driver side are also referred to simply as the "unit main circuit 41*m*" and the "unit sub-circuit 41*s*", respectively, and the unit main circuit 42*m* and the unit sub-circuits 42*s* on the second gate driver side are also referred to simply as the "unit main circuit 42*m*" and the "unit sub-circuit 42*s*", respectively.

2.2 Overall Configuration of Gate Driver

Figure 4:
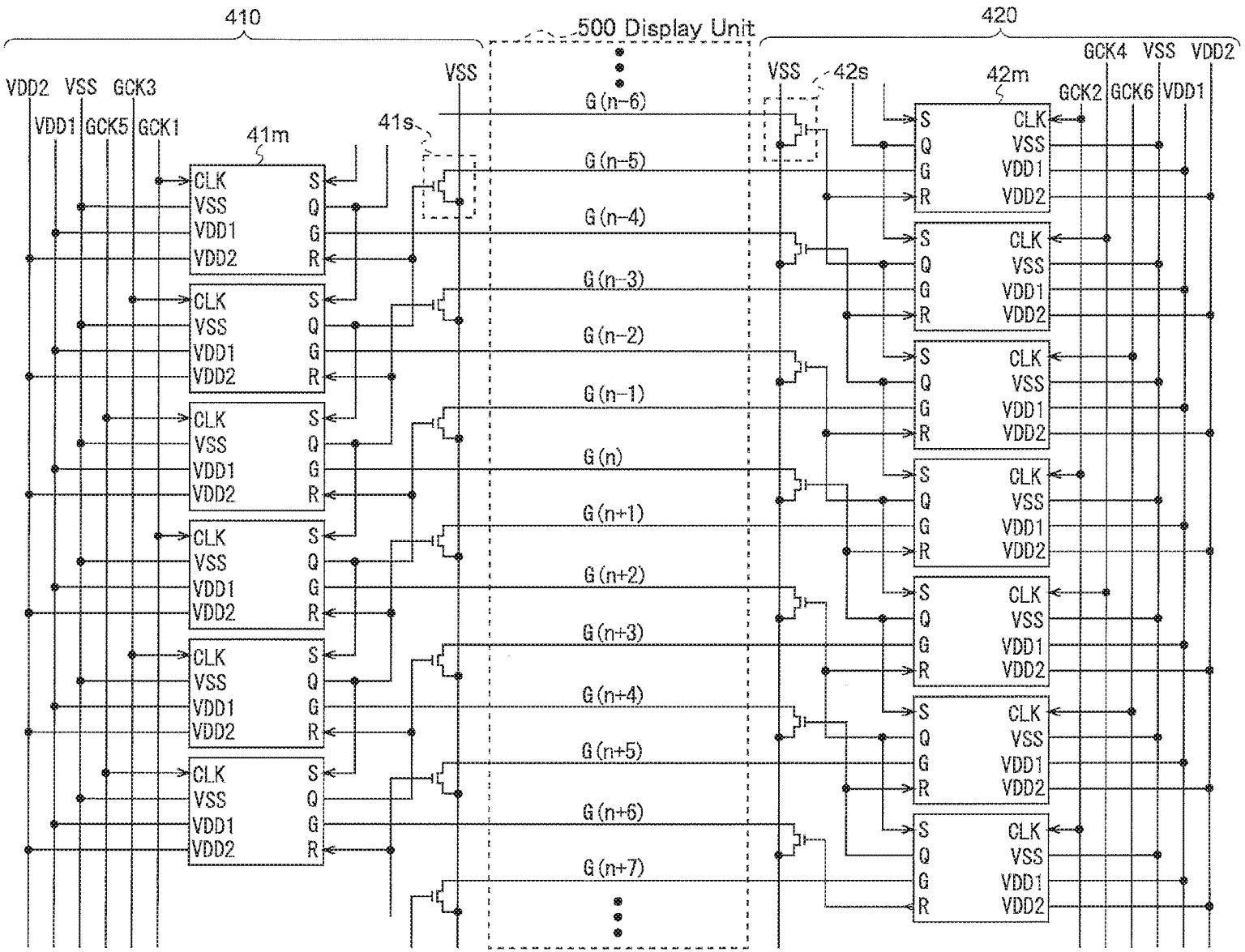
FIG. 4 is a circuit diagram showing an overall configuration of the gate driver in the embodiment.

FIG. 4 is a circuit diagram showing the overall configuration of the gate driver in the present embodiment. As shown in FIG. 4, the first gate driver 410 includes a plurality of unit main circuits 41*m* corresponding one-to-one to the odd-numbered gate bus lines GL1, GL3, . . . , GLn, . . . (n is an odd number) in the display unit 500, and includes a plurality of unit sub-circuits 41*s* corresponding one-to-one to the even-numbered gate bus lines GL2, GL4, . . . , GLn+1, . . . in the display unit 500. A driving output terminal G (corresponding to the connection point between the activation transistor T01 and the inactivation transistor T02) (see FIG. 3) of each unit main circuit 41*m* is connected to the corresponding gate bus line GLi1 (i1 is an odd number), and a scanning signal G(i1) is applied from the driving output terminal G to the corresponding gate bus line GLi1 (i1=1, 3, . . . , n−2, n, n+2, . . . ).

Each of the plurality of unit main circuits 41*m* functions as the bistable circuit including the activation transistor T01 and the inactivation transistor T02 (see FIG. 3), and the plurality of unit main circuits 41*m* are cascade-connected to constitute a shift register as shown in FIG. 4. That is, with regard to each unit main circuit 41*m*, the output signal Q of the preceding unit main circuit 41*m* is input into the set terminal S, the output signal Q of the subsequent unit main circuit 41*m* is input into the reset terminal R, a first high-voltage power-supply terminal VDD1 is supplied with the selection voltage VDD1 to be applied to the drain terminal of the internal activation transistor T01 (see FIG. 3), a second high-voltage power-supply terminal VDD2 is supplied with a second high-voltage power-supply voltage (also denoted by symbol "VDD2") for the internal bistable circuit 41*bs*, and a low-voltage power-supply terminal VSS is supplied with a voltage equal to the non-selection voltage VSS described above as a low-voltage power-supply voltage (also denoted by symbol "VSS") for the internal bistable circuit 41*bs* (see FIG. 3). In addition, the first, third, and fifth gate clock signals GCK1, GCK3, GCK5 out of the first to sixth gate clock signals GCK1 to GCK6 constituting the six-phase clock signal cyclically correspond to the plurality of unit main circuits 41*m* cascade-connected in the above manner, and the corresponding gate clock signal GCKk (k is any one of 1, 3, and 5) is input into the clock terminal CLK of each unit main circuit 41*m* (see FIG. 4). However, in order to operate the plurality of unit main circuits 41*m* as the shift register by the first, third, and fifth gate clock signals GCK1, GCK3, GCK5 in the six-phase clock signal having a duty ratio of 50%, for example, a dummy unit main circuit 41*m* is required on each of the leading stage and the last two stages of the plurality of unit main circuits 41*m* (see FIG. 4), and the first gate start pulse signal GSP1 which is on the H level for a predetermined period at the start of each frame period is input into the set terminal S on the leading stage of the plurality of unit main circuits including the dummy unit main circuits.

As shown in FIG. 4, the second gate driver 420 includes a plurality of unit main circuits 42*m* corresponding one-to-one to the even-numbered gate bus lines GL2, GL4, . . . , GLn+1, . . . in the display unit 500, and includes a plurality of unit sub-circuits 42*s* corresponding one-to-one to the odd-numbered gate bus lines GL1, GL3, . . . , GLn, . . . in the display unit 500. A driving output terminal G (corresponding to the connection point between the activation transistor T01 and the inactivation transistor T02) (see FIG. 3) of each unit main circuit 42*m* is connected to the corresponding gate bus line GLi2 (i2 is an even number), and a scanning signal G(i2) is applied from the driving output terminal G to the corresponding gate bus line GLi2 (i2=2, 4, . . . , n−1, n+1, . . . ).

Each of the plurality of unit main circuits 42*m* functions as the bistable circuit including the activation transistor T01 and the inactivation transistor T02 (see FIG. 3), and the plurality of unit main circuits 42*m* are cascade-connected to constitute a shift register as shown in FIG. 4. That is, the plurality of unit main circuits 42*m* are connected in the same manner as the plurality of unit main circuits 41*m* in the first gate driver 410, a first high-voltage power-supply terminal VDD1 is supplied with the selection voltage VDD1 to be applied to the drain terminal of the internal activation transistor T01 (see FIG. 3), a second high-voltage power-supply terminal VDD2 is supplied with a second high-voltage power-supply voltage VDD2 for the internal bistable circuit 4*lbs*, and a low-voltage power-supply terminal VSS is supplied with a voltage equal to the non-selection voltage VSS described above as a low-voltage power-supply voltage VSS for the internal bistable circuit 41*bs* (see FIG. 3). In addition, the second, fourth, and sixth gate clock signals GCK2, GCK4, GCK6 out of the first to sixth gate clock signals GCK1 to GCK6 constituting the six-phase clock signal cyclically correspond to the plurality of unit main circuits 42*m* cascade-connected in the above manner, and the corresponding gate clock signal GCKk (k is any one of 2, 4, and 6) is input into the clock terminal CLK of each unit main circuit 42*m* (see FIG. 4). However, in order to operate the plurality of unit main circuits 42*m* as the shift register by the second, fourth, and sixth gate clock signals GCK2, GCK4, GCK6 in the six-phase clock signal having a duty ratio of 50%, for example, a dummy unit main circuit 42*m* is required on each of the leading stage and the last stage of the plurality of unit main circuits 42*m* (see FIG. 4), and the second gate start pulse signal GSP2 which is on the H level for a predetermined period at the start of each frame period is input into the set terminal S on the leading stage of the plurality of unit main circuits including the dummy unit main circuits.

Each unit sub-circuit 41*s* in the first gate driver 410 includes the inactivation auxiliary transistor T03, and the inactivation auxiliary transistor T03 has a gate terminal connected to an output terminal Q (an output terminal of the internal bistable circuit 41*bs*) of the unit main circuit 41*m* subsequent to the unit main circuit 41*m* that corresponds to the gate bus line GLi2+1 (i2 is an even number: i2=2, 4, . . . , n+1, . . . ) following the corresponding gate bus line GLi2, a drain terminal connected to the corresponding gate bus line GLi2, and a source terminal connected to the low-voltage power-supply line VSS as the second power supply line for supplying the non-selection voltage VSS described above.

Each unit sub-circuit 42*s* in the second gate driver 420 also includes the inactivation auxiliary transistor T03, and the inactivation auxiliary transistor T03 has a gate terminal connected to an output terminal Q (an output terminal of the internal bistable circuit 41*bs*) of the unit main circuit 42*m* subsequent to the unit main circuit 42*m* that corresponds to the gate bus line GLi1+1 (i1 is an odd number: i1=1, 3, . . . , n, . . . ) following the corresponding the gate bus line GLi1, a drain terminal connected to the corresponding gate bus line GLi1, and a source terminal connected to the low-voltage power-supply line VSS for supplying the non-selection voltage VSS described above.

In the gate driver configured as described above, the shift register made up of the plurality of unit main circuits 41*m* in the first gate driver 410 sequentially transfers a pulse of the first gate start pulse signal GSP1 in each frame period and, in response thereto, sequentially applies the active scanning signal (H-level signal) to the odd-numbered gate bus lines GL1, GL3, GL5, . . . in the display unit 500. The shift register made up of the plurality of unit main circuits 42*m* in the second gate driver 420 sequentially transfers a pulse of the second gate start pulse signal GSP2 in each frame period and, in response thereto, sequentially applies the active scanning signal (H-level signal) to the even-numbered gate bus lines GL2, GL4, GL6, . . . in the display unit 500. As a result, the gate bus lines GL1 to GLM in the display unit 500 sequentially come into the selected state for each predetermined period (each horizontal period) in each frame period. As a result, each gate bus line GLi (i=1 to N) in the selected state shifts to the H level and charges are accumulated (in the wiring capacitance of the relevant gate bus line).

Also, in the first gate driver 410, in response to the sequential transfer of the pulse of the first gate start pulse signal GSP1 by the internal shift register, the inactivation auxiliary transistor (corresponding to the transistor T03 shown in FIG. 3) constituting the plurality of unit sub-circuits 41*s*, which are connected respectively to the even-numbered gate bus lines GL2, GL4, GL6, . . . in the display unit 500, are sequentially turned on. Thus, when the even-numbered gate bus lines GLi2 (i2=2, 4, 6, . . . ) in the display unit 500 are to be brought into the non-selected state, not only the end portion of the gate bus line GLi2 on the second gate driver 420 side is connected to the low-voltage power-supply line VSS via the inactivation transistor (corresponding to the transistor T02 shown in FIG. 3) in the corresponding unit main circuit 42*m*, but also the end portion of the gate bus line GLi2 on the first gate driver 410 side is connected to the low-voltage power-supply line VSS via the inactivation auxiliary transistor in the corresponding unit sub-circuit 41*s*. As a result, the charges accumulated in (the wiring capacitance of) the gate bus line GLi2 are released from both ends of the gate bus line.

Further, in the second gate driver 420, in response to the sequential transfer of the pulse of the second gate start pulse signal GSP2 by the internal shift register, the inactivation auxiliary transistor (corresponding to the transistor T03 shown in FIG. 3) constituting the plurality of unit sub-circuits 42*s*, which are connected respectively to the odd-numbered gate bus lines GL1, GL3, GL5, . . . in the display unit 500, are sequentially turned on. Thus, when the odd-numbered gate bus lines GLi1 (i1=1, 3, 5, . . . ) in the display unit 500 are to be brought into the non-selected state, not only the end portion of the gate bus line GLi1 on the first gate driver 410 side is connected to the low-voltage power-supply line VSS via the inactivation transistor (corresponding to the transistor T02 shown in FIG. 3) in the corresponding unit main circuit 41*m*, but also the end portion on the second gate driver 420 side is connected to the low-voltage power-supply line VSS via the inactivation auxiliary transistor in the corresponding unit sub-circuit 42*s*. As a result, the charges accumulated in (the wiring capacitance of) the gate bus line GLi1 are released from both ends of the gate bus line.

According to the gate driver configured as described above, the signal input into the gate terminal of the inactivation auxiliary transistor (T03) of each unit sub-circuit 41*s* in the first gate driver 410 is generated by (the bistable circuit 41*bs* included in) a unit main circuit 41*m* in the first gate driver 410. Therefore, a signal generated in the second gate driver 420 is not required for controlling the inactivation auxiliary transistors of each unit sub-circuit 41*s* in the first gate driver 410. For the same reason, a signal generated in the first gate driver 410 is not required for controlling the inactivation auxiliary transistor of each unit sub-circuit 42*s* in the second gate driver 420.

2.3 Detailed Configuration of Gate Driver

Figure 5:
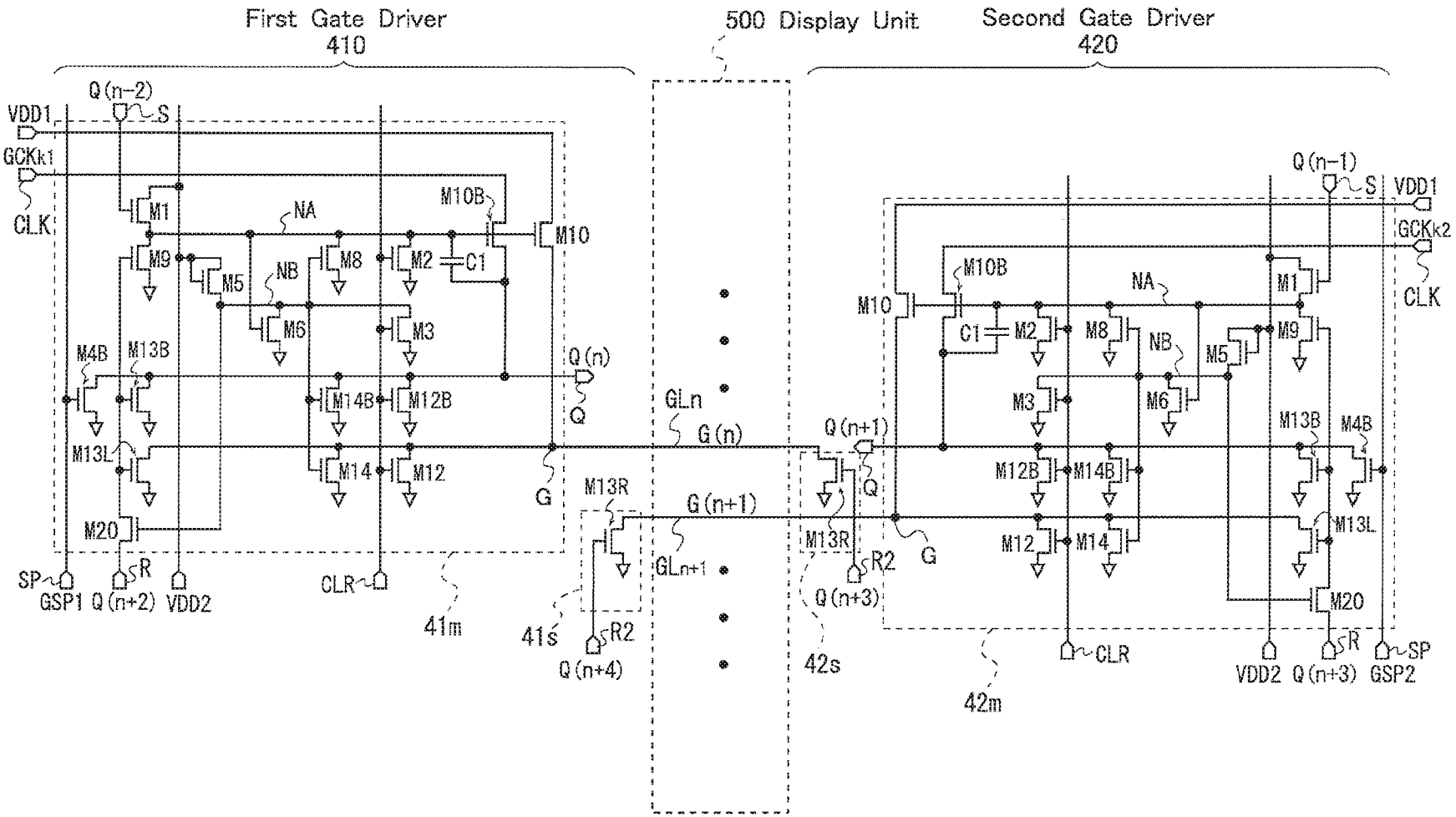
FIG. 5 is a circuit diagram for explaining a detailed configuration example of first and second gate drivers in the embodiment.

FIG. 5 is a circuit diagram for explaining a detailed configuration example of the gate driver in the present embodiment, which illustrates an example of a detailed configuration of the unit main circuit 41*m* and the unit sub-circuit 42*s* corresponding to the nth gate bus line GLn, and the unit main circuit 42*m* and the unit sub-circuit 41*s* corresponding to the (n+1)th gate bus line GLn+1 (n is an odd number). The unit main circuits 41*m*, 42*m* and the unit sub-circuits 41*s*, 42*s* corresponding to the other gate bus lines GLi, GLi+1 (i=1, 3, 5, . . . , n−2, n+2, . . . ) in the display unit 500 each have a similar configuration to the configuration shown in FIG. 5, and a detailed description thereof will be omitted. In the following description, in the case of distinguishing the unit main circuit 41*m* and the unit sub-circuit 42*s* corresponding to the odd-numbered gate bus line GLi1 from the other unit main circuits 41*m* and the other unit sub-circuits 42*s*, reference numerals "41*m*(*i*1)", "42*s*(*i*1)" are used in place of reference numerals "41*m*", "42*s*" (i1 is an odd number of 1≤i1≤N), respectively, and in the case of distinguishing the unit main circuit 42*m* and the unit sub-circuit 41*s* corresponding to the even-numbered gate bus line GLi2 from the other unit main circuits 42*m* and the other unit sub-circuits 41*s*, reference numerals "42*m*(*i*2)", "41*s*(*i*2)" are used in place of reference numerals "42*m*", "41*s*" (i2 is an even number of 1≤i2≤N), respectively.

In the configuration example shown in FIGS. 4 and 5, in the first gate driver 410, the unit main circuit 41*m*(*n*) corresponding to the nth gate bus line GLn is implemented by connection of transistors M1, M2, M3, M4B, M5, M6, M8, M9, M10, M10B, M12, M12B, M13L, M13B, M14, M14B, M20 and a capacitor C1 as shown in FIG. 5. An output signal Q(n−2) of the preceding unit main circuit 41*m*(*n*−2) is input into the set terminal S, an output signal Q(n+2) of the subsequent unit main circuit 41*m*(*n*+2) is input into the reset terminal R, and the gate clock signal GCKk1 is input into the clock terminal CLK (k1 is any one of 1, 3, and 5, and here, k1=1). The transistor M10 corresponds to the activation transistor T01 shown in FIG. 3, the transistor M13L corresponds to the inactivation transistor T02 shown in FIG. 3, and a scanning signal G(n) is applied from the connection point (G) of the transistor M10 and the transistor M13L to the nth gate bus line GLn. The first gate start pulse signal GSP1 is input into an SP terminal of each unit main circuit 41*m* and a clear signal for initializing the shift register is input into a clear terminal CLR. However, while the function and operation of each of these are apparent to a person skilled in the art, these are not directly related to the present embodiment, and a detailed explanation will be omitted.

In the second gate driver 420, the unit sub-circuit 42*s*(*n*) corresponding to the nth gate bus line GLn is implemented by using a transistor M13R, and this transistor M13R has a gate terminal connected to an output terminal Q (a terminal to which an output signal Q(n+3) is output) of a unit main circuit 42*m*(*n*+3) corresponding to an (n+3)th gate bus line GLn+3, a drain terminal connected to the nth gate bus line GLn, and a source terminal connected to the low-voltage power-supply line VSS. The transistor M13R corresponds to the inactivation auxiliary transistor T03 shown in FIG. 3.

In the second gate driver 420, as shown in FIG. 5, the unit main circuit 42*m*(*n*+1) corresponding to the (n+1)th gate bus line GLn+1 is also implemented by the configuration as that of the unit main circuit 41*m*(*n*) corresponding to the nth gate bus line GLn. Further, in the first gate driver 410, the unit sub-circuit 41*s*(*n*+1) corresponding to the (n+1)th gate bus line GLn+1 is also implemented by the same configuration as that of the unit sub-circuit 42*s*(*n*) corresponding to the nth gate bus line GLn as shown in FIG. 5. However, the scanning signal G(n+1) is applied to the gate bus line GLn+1 from the unit main circuit 42*m*(*n*+1) corresponding to the (n+1)th gate bus line GLn+1, and the transistor M13R in the unit sub-circuit 41*s*(*n*+1) corresponding to the (n+1)th gate bus line GLn+1 has a gate terminal connected to an output terminal Q (a terminal to which an output signal Q(n+4) is output) of a unit main circuit 41*m*(*n*+4) corresponding to an (n+4)th gate bus line GLn+4. In the unit main circuit 42*m*(*n*+1), an output signal Q(n−1) of the preceding unit main circuit 42*m*(*n*−1) is input into the set terminal S, the output signal Q(n+3) of the subsequent unit main circuit 42*m*(*n*+3) is input into the reset terminal R, and the gate clock signal GCKk2 is input into the clock terminal CLK (k2 is any one of 2, 4, and 6, and here, k2=2). Note that the configuration of the unit main circuits 41*m*, 42*m* in the present embodiment is not limited to the configuration shown in FIG. 5, and the unit main circuits 41*m* and 42*m* including RS flip-flops of other configurations may be used.

2.4 Operation of Gate Driver

Figure 6:
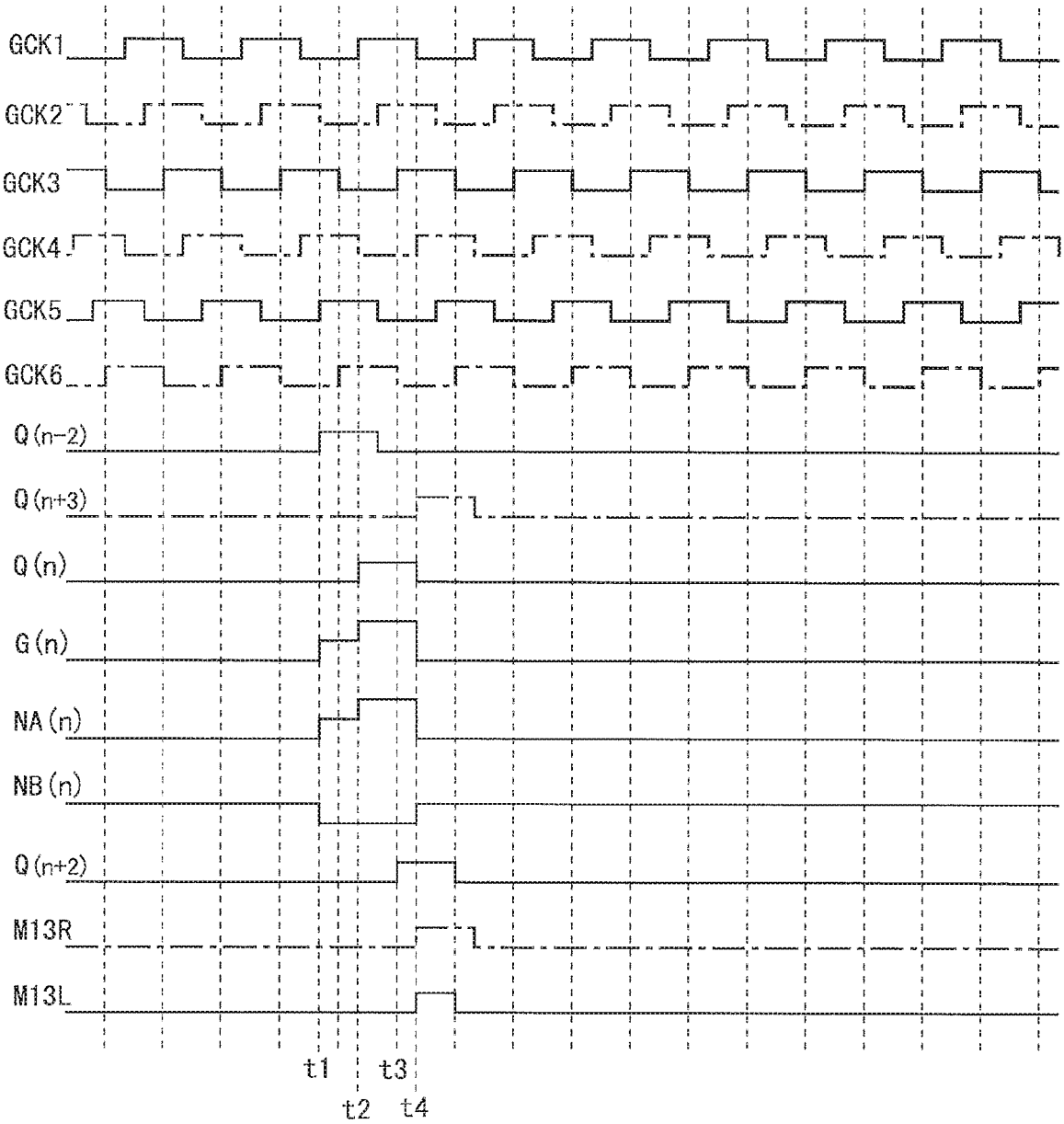
FIG. 6 is a signal waveform diagram for describing operation of the gate driver in the embodiment.

Next, the operation of the gate driver configured as shown in FIGS. 4 and 5 in the present embodiment will be described. FIG. 6 is a signal waveform diagram for explaining the operation of the gate driver according to this configuration example. Here, it is assumed that a six-phase clock signal having a duty ratio of 50% and made up of the first to sixth gate clock signals GCK1 to GCK6 as shown in FIG. 6 is generated by the display control circuit 200. As shown in FIG. 4, the first, third, and fifth gate clock signals GCK1, GCK3, GCK5 of the six-phase clock signals are supplied to the shift register in the first gate driver 410, and the second, fourth, and sixth gate clock signals GCK2, GCK4, GCK6 are supplied to the shift register in the second gate driver 420. As shown in FIG. 4, in the unit main circuit 41*m*(*n*) corresponding to the nth gate bus line GLn among the unit main circuits 41*m* constituting the shift register of the first gate driver 410, the first gate clock signal GCK1 is applied to the clock terminal CLK, and in the unit main circuit 42*m*(*n*+1) corresponding to the (n+1)th gate bus line GLn+1 among the unit main circuits 42*m* constituting the shift register of the second gate driver 420, the second gate clock signal GCK2 is applied to the clock terminal CLK.

A signal which is on the H level just for a predetermined period at the start of the display device is applied as an initialization signal to the CLR terminal of each of unit main circuits 41*m*, 42*m*, the first gate start pulse signal GSP1 is applied to the SP terminal of each unit main circuit 41*m* in the first gate driver 410, the second gate start pulse signal GSP2 is applied to the SP terminal of each unit main circuit 42*m* in the second gate driver 420, and each of the first and second gate start pulse signals GSP1, GSP2 is on the H level just for a predetermined period at the start of each frame period. As a result, at the point when the first gate start pulse signal GSP1 shifts to an L level after the start point of each frame period, a first node NA as a charge holding node in each unit main circuit 41*m* is at the low level (L level), and a second node NB as a stabilization node is at the high level (H level). Further, at the point when the second gate start pulse signal GSP2 shifts to the L level after the start point of each frame period, the first node NA as a charge holding node in each unit main circuit 42*m* is at the low level (L level), and a second node NB as a stabilization node is at the high level (H level).

Attention is now focused on the unit main circuit 41*m*(*n*) corresponding to the nth gate bus line GLn, and there will be considered the operation in a case where a pulse of the output signal Q(n−2) of the preceding unit main circuit 41*m*(*n*−2) is input into the set terminal S of the unit main circuit 41*m*(*n*) while the first node NA is on the L level and the second node NB is on the H level.

As shown in FIG. 6, the output signal Q(n−2) of the preceding unit main circuit 41*m*(*n*−2), which is input into the set terminal S of the focused unit main circuit 41*m*(*n*), changes from the L level to the H level at a time t1, whereby the transistor M1 is turned on and the capacitor C1 is charged. As a result, the potential of the first node NA shifts to the H level, and hence the transistors M10, M10B are turned on. By turning-on of the transistor M10, the selection voltage VDD1 supplied by the first high-voltage power-supply line VDD1 is output from the driving output terminal G to the gate bus line GLn as the scanning signal G(n). By turning-on of the transistor MOB, the first gate clock signal GCK1 being input from the clock terminal CLK is output from the output terminal Q as the output signal Q(n). The first gate clock signal GCK1 changes from the L level to the H level at a time t2, thereby raising the potential of the first node NA via the capacitor C1 to a potential higher than the H level. As a result, the transistor M10 is completely turned on, and the voltage of the scanning signal G(n) which is output to the gate bus line GLn shifts completely to the H level.

Thereafter, at a time t3, the signal being input into the reset terminal R of the unit main circuit 41$m(n)$, namely the output signal Q(n+2) of the subsequent unit main circuit 41$m(n+2)$, changes from the L level to the H level. However, at this time t3, since the transistor M6 is in the on-state and the potential of the second node NB is at the L level, the transistor M20 is in the off-state. Hence the potential of the first node NA, the output signal Q(n), and the scanning signal G(n) do not change. Thereafter, at a time t4, the first gate clock signal GCK1 being input from the clock terminal CLK changes from the H level to the L level, whereby the potential of the first node NA decreases and the transistor M6 changes from the on-state toward the off-state. As a result, the potential of the second node NB increases and the transistor M20 changes from the off-state toward the on-state, whereby the transistor M9 changes from the off-state toward the on-state, and the potential of the first node NA further decreases. In this manner, the potential of the first node NA shifts completely to the L level, whereby the transistor M13L is completely turned on.

As thus described, the subsequent output signal Q(n+2), which is input into the reset terminal R, is applied to the gate terminal of the transistor M13L not directly but via the transistor M20, thereby adjusting the timing at which the transistor M13L changes from the off-state to the on-state. This is because the transistor M13L as the inactivation switching element in the unit main circuit 41$m(n)$ and the transistor M13R as the inactivation auxiliary switching element in the unit sub-circuit 42$s(n)$ are turned on at the same time (time t4). That is, the transistor M20 functions as a timing adjustment circuit that adjusts the timing at which the transistor M13L as the inactivation switching element is turned on, together with the transistors M5, M6, M10B and the capacitor C1. Based on the gate clock signal GCK1 input into the clock terminal CLK and the subsequent output signal Q(n+2) input into the reset terminal R (see FIG. 6), the timing adjustment circuit generates a control signal for the transistor M13L so that the transistors M13L and the transistor M13R, which are connected respectively to one end and the other end of the same scanning signal line GLn, are turned on at the same time. Likewise, also in the unit main circuit 42$m(n+1)$, the transistor M20 function as the timing adjustment circuit that generates a control signal for the transistor M13L so that the transistors M13L and the transistor M13R, which are connected respectively to one end and the other end of the same scanning signal line GLn+1, are turned on at the same time, together with the transistors M5, M6, M10B and the capacitor C1.

By the above operation, at the time t4, the state where the first high-voltage power-supply voltage VDD1 (fixed voltage) as the selection voltage is output as the scanning signal G(n) to the gate bus line GLn via the transistor M10 is switched over to the state where the low-voltage power-supply voltage VSS (fixed voltage) as the non-selection voltage is output to the gate bus line GLn via the transistor M13L as the scanning signal G(n). That is, at the time t4, the end portion of the nth gate bus line GLn on the first gate driver 410 side is grounded (connected to the low-voltage power-supply line VSS) via the transistor M13L.

Meanwhile, in the second gate driver 420, at the time t4, the signal being input into the gate terminal of the transistor M13R of the unit sub-circuit 42$s(n)$ corresponding to the nth gate bus line GLn, namely the output signal Q(n+3) of the unit main circuit 42$m(n+3)$ corresponding to the (n+3)th gate bus line GLn+3, changes from L level to the H level. As a result, the end portion of the nth gate bus line GLn on the side of the second gate driver 420 is grounded (connected to the low-voltage power-supply line VSS) via the transistor M13R.

In this manner, when the transistor M10 in the unit main circuit 41$m(n)$ is in the on-state, the selection voltage VDD1 is output to the gate bus line GLn, so that the gate bus line GLn comes into the selected state and charges are accumulated in (the wiring capacitance of) the gate bus line GLn. At the time t4, both the transistor M13L in the unit main circuit 41$m(n)$ and the transistor M13R in the unit sub-circuit 42$s(n)$ are turned on, so that the accumulated charges are released at both ends of the gate bus line GLn and the gate bus line GLn comes into the non-selected state (see FIG. 10 to be described later).

The unit main circuit 42$m(n+1)$ and the unit sub-circuit 41$s(n+1)$ corresponding to the (n+1)th gate bus line GLn+1 perform the same operation as the operation of the unit main circuit 41$m(n)$ and the unit sub-circuit 42$s(n)$ corresponding to the nth gate bus line GLn, respectively. As a result, at timing according to the second gate clock signal GCK2 that is input into the clock terminal CLK of the unit main circuit 42$m(n+1)$, the first high-voltage power-supply voltage VDD1 (fixed voltage) as the selection voltage is output to the (n+1)th gate bus line GLn+1 as the scanning signal G(n+1) via the transistor M10, and as a result, the gate bus line GLn+1 comes into the selected state and charges are accumulated in (the wiring capacitance of) the gate bus line GLn+1. Thereafter, both the transistor M13L in the unit main circuit 42$m(n+1)$ and the transistor M13R in the unit sub-circuit 41$s(n+1)$ are turned on, so that the accumulated charges are released from both ends of the gate bus line GLn+1, and the gate bus line GLn+1 comes into the non-selected state.

3. Operation and Effect

Figure 7:
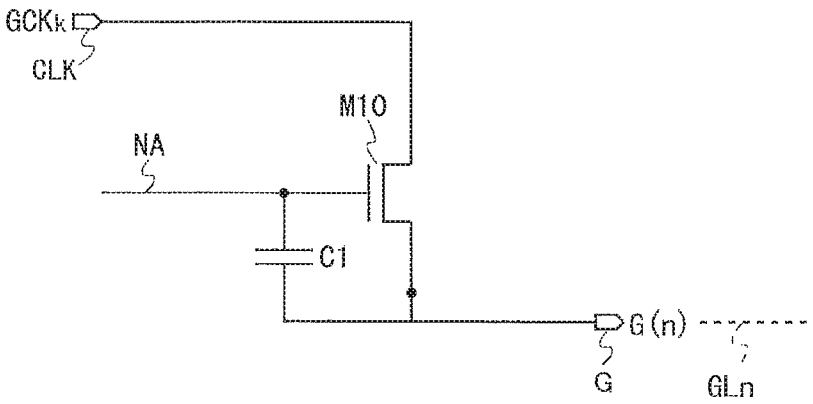
FIG. 7 is a circuit diagram for explaining an alternating current (AC) buffer method in a gate driver of an active matrix-type display device.

FIG. 7 is a circuit diagram showing a configuration example of the output unit of the scanning signal G(n) in the conventional gate driver that operates with the six-phase clock signal made up of the first to sixth gate clock signals. The output unit of this configuration example includes the transistor M10 as the output switching element and the capacitor C1 as a boost capacitance. The transistor M10 has a gate terminal connected to the node NA (a node equivalent to the first node NA in the unit main circuits 41$m$, 42$m$ shown in FIG. 5), a drain terminal connected to the clock terminal CLK, and a source terminal connected to the output terminal Q. One end of the capacitor C1 is connected to the gate terminal of the transistor M10, and the other end thereof is connected to the source terminal of the transistor M10. The gate clock signal GCKk (k is any one of 1, 3, and 5 when n is an odd number and k is any one of 2, 4, and 6 when n is an even number) is input into the clock terminal CLK, and as a reset signal Reset, the output signal Q(n+2) of the subsequent unit main circuit is input. In the configuration shown in FIG. 7, the gate clock signal GCKk changing between the H level and the L level is output as the scanning signal G(n), and hence in the following description, the configuration shown in FIG. 7 will be referred to as an "AC buffer method."

Figure 8:
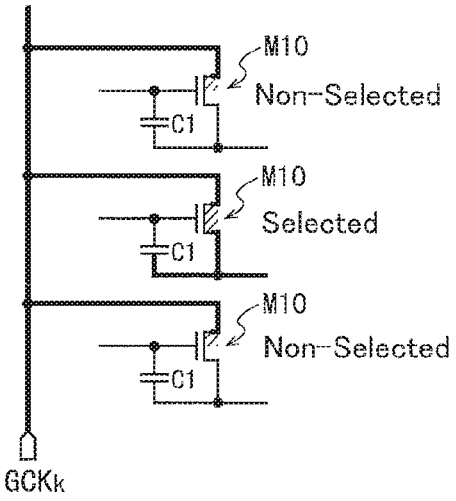
FIG. 8 is a diagram for explaining power consumption in a case where the AC buffer method has been adopted in the gate driver.

Generally, in the gate driver, the same gate clock signal GCKk is supplied to a plurality of stages (one stage corresponds to the unit main circuits 41*m*, 42*m* in the present embodiment) in its internal shift register. In the conventional gate driver where the AC buffer method as shown in FIG. 7 has been adopted, as shown in FIG. 8, not only that the gate bus line in the selected state is charged and discharged by the above gate clock signal GCKk via the transistor M10 as the output switching element of the stage corresponding to the gate bus line, but also that about half of the channel capacitance of the transistor M10 as the output switching element of the stage corresponding to the gate bus line in the non-selected state is also charged and discharged by the above gate clock signal GCKk (in FIG. 8, portions related to the charging and discharging by the gate clock signal GCKk are indicated by bold lines and by hatching with diagonal lines). For reducing the power consumption in the gate driver where such an AC buffer method has been adopted, it is considered that the number of stages (the number of output switching elements) to which the same gate clock signal GCKk is supplied is reduced by increasing the number of phases of the clock signal. However, when the number of phases is increased, the number of signal lines for supplying the gate clock signal is increased, and the picture-frame region of the gate driver monolithic panel (GDM panel) increases.

Figure 9:
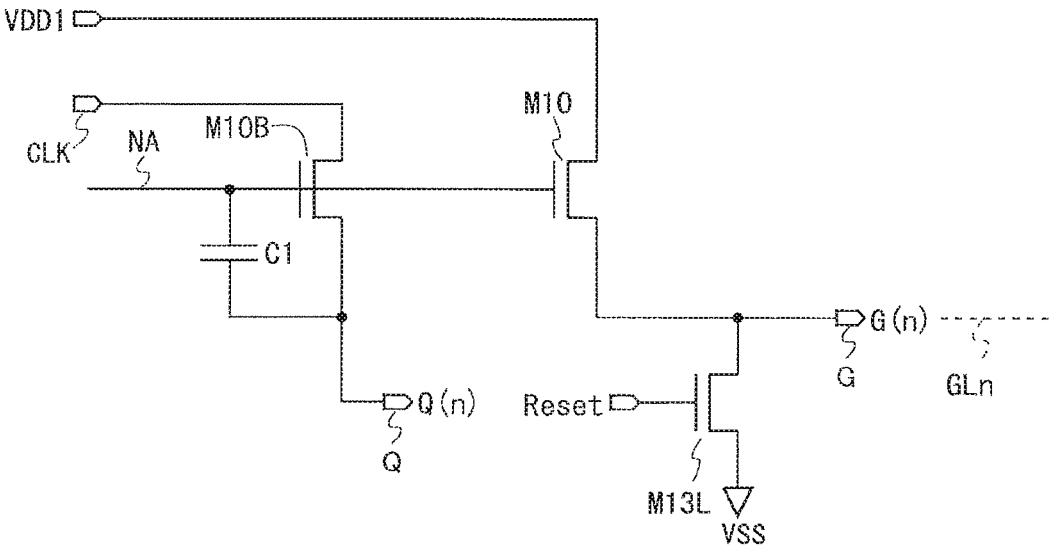
FIG. 9 is a circuit diagram for explaining a direct current (DC) buffer method in the gate driver of the active matrix-type display device.

FIG. 9 is a circuit diagram showing the configuration of the output units of the output signal Q(n) and the scanning signal G(n) in the unit main circuit 41*m* (when n is an odd number) or the unit main circuit 42*m* (when n is an even number) within the gate drivers shown in FIG. 5. As shown in FIG. 9, the output unit of the output signal Q(n) includes the transistor M10B as the output switching element and the capacitor C1 as the boost capacitance. The transistor M10B has a gate terminal connected to the first node NA, a drain terminal connected to the clock terminal CLK, and a source terminal connected to the output terminal Q. One end of the capacitor C1 is connected to the gate terminal of the transistor M10B and the other end of the capacitor C1 is connected to the source terminal of the transistor M10B. The output unit of the scanning signal G(n) includes the transistor M10 as the activation switching element and the transistor M13L as the inactivation switching element. The transistor M10 has a gate terminal connected to the first node NA, a drain terminal connected to the first high-voltage power-supply line VDD1, and a source terminal connected to the driving output terminal G (gate bus line GLn). The transistor M13L has a gate terminal connected to a signal line of the reset signal Reset (in the configuration of FIG. 5, the gate terminal is connected to the reset terminal R via the transistor M20), a drain terminal connected to the driving output terminal G (gate bus line GLn), and a source terminal connected to the low-voltage power-supply line VSS. The gate clock signal GCKk (k is any one of 1, 3, and 5 when n is an odd number and k is any one of 2, 4, and 6 when n is an even number) is input into the clock terminal CLK, and as the reset signal Reset, the output signal Q(n+2) of the subsequent unit main circuit is input. In the configuration shown in FIG. 9, since the voltage output as the scanning signal G(n) is switched between the first high-voltage power-supply voltage VDD1 being the fixed voltage and the low-voltage power-supply voltage VSS being the fixed voltage, the configuration shown in FIG. 9 is referred to as a "DC buffer method."

In the gate driver according to the present embodiment where the DC buffer method has been adopted as shown in FIG. 9, unlike the configuration of the AC buffer method shown in FIG. 7, the transistors M10, M13L as the switching elements connected to the gate bus line GLn are supplied with the first high-voltage power-supply voltage (selection voltage) VDD1 and the low-voltage power-supply voltage (non-selection voltage) VSS which are the fixed voltages, respectively, instead of the gate clock signal GCKk, and with these voltages VDD1, VSS, only the gate bus line GLn in the selected state is charged and discharged (more precisely, charging is performed when the gate bus line GLn is changed from the non-selected state to the selected state, and discharging is performed when the gate bus line GLn is changed from the selected state to the non-selected state.) Therefore, according to the present embodiment, it is possible to reduce the power consumption without increasing the number of phases of the clock signal for the operation of the gate driver.

Figure 10:
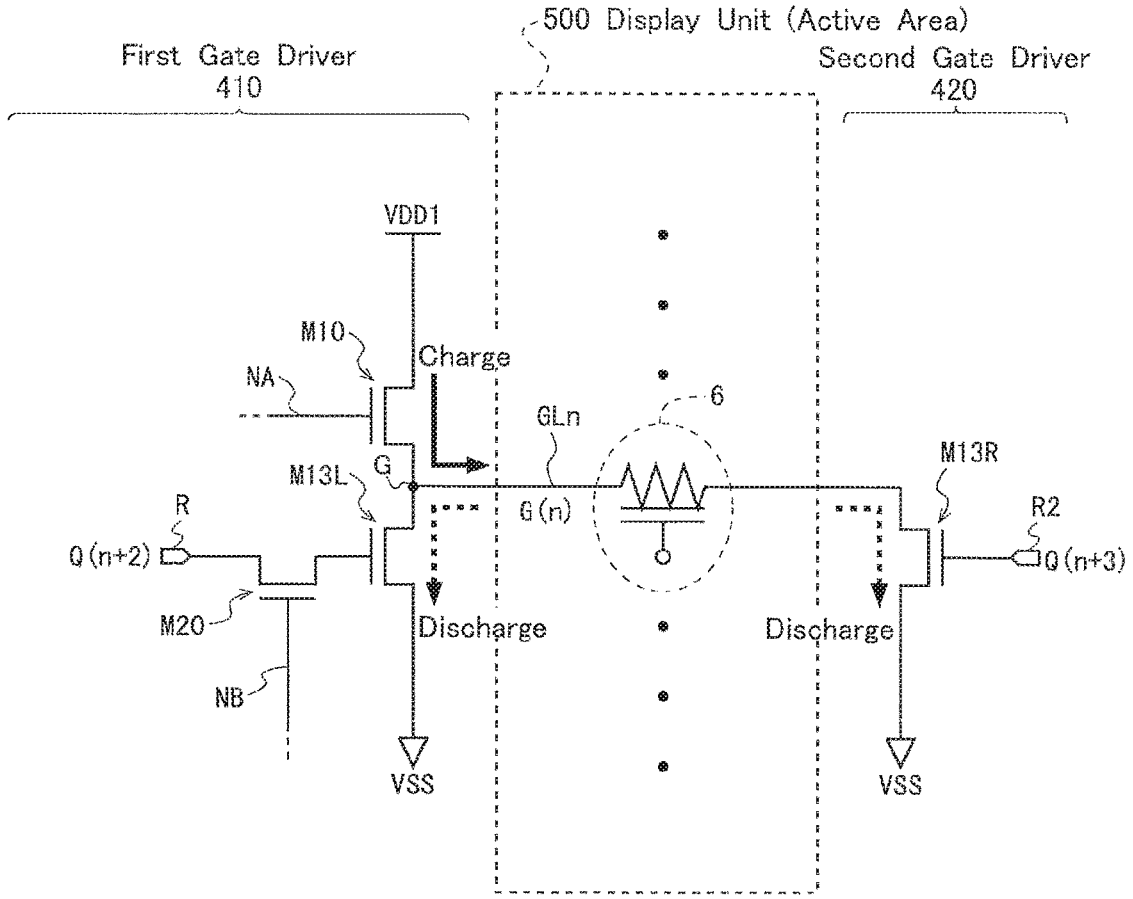
FIG. 10 is a circuit diagram showing a configuration of an output unit in a unit main circuit and a unit sub-circuit which correspond to one gate bus line within the gate drivers in the embodiment.

FIG. 10 is a circuit diagram showing a configuration of the output unit of the scanning signal G(n) in the unit main circuit 41*m*(*n*) and the unit sub-circuit 42*s*(*n*) which correspond to the nth gate bus line GLn (n is an odd number) within the gate drivers shown in FIGS. 4 and 5 in the present embodiment. As described with reference to FIG. 9, the output unit of the scanning signal G(n) in the unit main circuit 41*m*(*n*) includes the transistor M10 as the activation switching element and the transistor M13L as the inactivation switching element and has the connection configuration as shown in FIG. 10. The connection point (driving output terminal G) between the transistor M10 and the transistor M13L is connected to one end (the end portion on the first gate driver side) of the gate bus line GLn, and a voltage at the connection point is applied as the scanning signal G(n) to the gate bus line GLn. Further, the gate terminal of the transistor M13L in this output unit is connected to the reset terminal R via the transistor M20 as the switching element, and the gate terminal of the transistor M20 is connected to the second node NB (see FIG. 5). The output signal Q(n+2) of the unit main circuit 41*m*(*n*+2) subsequent to the unit main circuit 41*m*(*n*) is applied to the reset terminal R, and the output signal Q(n+2) having passed through the transistor M20 corresponds to the reset signal Reset shown in FIG. 9.

The unit sub-circuit 42*s*(*n*) corresponding to the nth gate bus line GLn includes the transistor M13R as the inactivation auxiliary switching element. The transistor M13R has a gate terminal connected to the output terminal Q of the subsequent unit main circuit 42*m*(*n*+3), a drain terminal connected to the other end (the end portion on the second gate driver side) of the gate bus line GLn, and a source terminal grounded (connected to the low-voltage power-supply line VSS). The gate terminal of the transistor M13R corresponds to a reset terminal R2 of the unit sub-circuit 42*s*(*n*), and the output signal Q(n+3) of the unit main circuit 42*m*(*n*+3) is applied to the reset terminal R2.

In the gate driver according to the present embodiment, when the nth gate bus line GLn is to be selected, the potential of the first node NA shifts to the H level and the transistor M10 is turned on in the unit main circuit 41*m*(*n*), whereby the first high-voltage power-supply voltage VDD1 as the selection voltage is output to the gate bus line GLn and the gate bus line GLn (wiring capacitance constituting the gate load 6) is charged with the first high-voltage power-supply voltage VDD1. In a period during which the gate bus line GLn is in the selected state, the transistors M13L, M13R are both in the off-state. Thereafter, when the gate bus line GLn is to be changed from the selected state to the non-selected state, the transistor M20 is turned on and the subsequent H-level output signal Q(n+2) in the first gate driver 410 is applied to the gate terminal of the transistor M13L, and the subsequent output signal Q(n+3) in the second gate driver 420 is applied to the gate terminal of the transistor M13R (see the signal waveforms before and after the time t4 shown in FIG. 6). As a result, the transistors M13L, M13R are turned on and both ends of the gate bus line GLn are grounded (the low-voltage power-supply voltage VSS is applied to both ends), whereby the charges accumulated in the gate bus line GLn are released from both ends of the gate bus line, as shown in FIG. 10.

In the above description, the configuration and the operation of the output unit of the scanning signal G(n) and the unit sub-circuit 42*s*(*n*) in the unit main circuit 41*m*(*n*) which correspond to the odd-numbered gate bus line GLn have been described, but the configuration and the operation of the output unit of the scanning signal G(n+1) in the unit main circuit 42*m*(*n*+1) and the unit sub-circuit 41*s*(*n*+1) which correspond to the even-numbered gate bus line GLn+1 are substantially the same as above. However, with regard to the even-numbered gate bus line GLn+1, the unit sub-circuit 41*s*(*n*+1) is connected to the end portion on the first gate driver side, and the unit main circuit 42*m*(*n*+1) is connected to the end portion of the second gate driver side.

According to the above configuration, it is possible to narrow the picture-frame of the liquid crystal panel 600 while reducing blunting of the falling waveform of the scanning signals G(1) to G(N). Hereinafter, this point will be described in detail with reference to FIGS. 11 to 14.

Figure 11A:
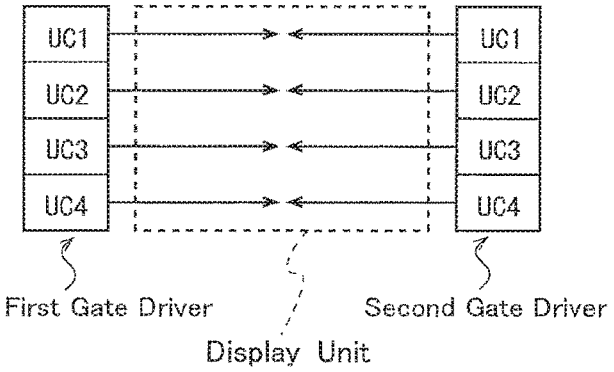
FIG. 11A is a schematic diagram for explaining a gate driver of a two-sided input method.
Figure 11B:
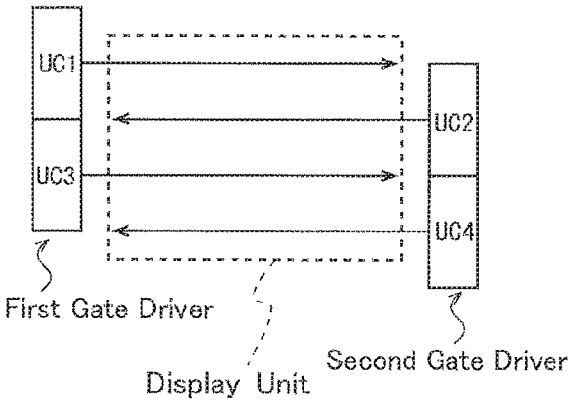
FIG. 11B is a schematic diagram for explaining a gate driver of a one-sided input method.

In the case where the gate driver is made up of the first and second gate drivers facing each other via the display unit, there are methods as follows: a method as shown in FIG. 11A in which the scanning signals are applied to each gate bus line in the display unit from both ends of each gate bus line (hereinafter referred to as "two-sided input method"); and a method as shown in FIG. 11B in which the scanning signals are alternately applied to the gate bus line in the display unit alternately from the one end and the other end of the gate line, for example, a method in which the scanning signal is applied from the first gate driver to one end of each of the odd-numbered gate bus lines, and the scanning signal is applied from the second gate driver to the other end of each of the even-numbered gate bus lines (hereinafter referred to as "one-sided input method").

In the two-sided input method, the pitch of the monolithic gate driver (the length in the extending direction of the data signal line for the circuit portion of the driver which corresponds to one gate bus line) is one pixel, and the area of the picture-frame region in the GDM becomes larger (FIG. 11A).

In contrast, in the one-sided input method, by alternately applying the scanning signals to one ends and the other ends of the odd-numbered gate bus lines and the even-numbered gate bus lines, the pitch of the monolithic gate driver becomes two pixels, and the area of the picture-frame region in the GDM panel can be reduced (FIG. 11B).

Figure 12:
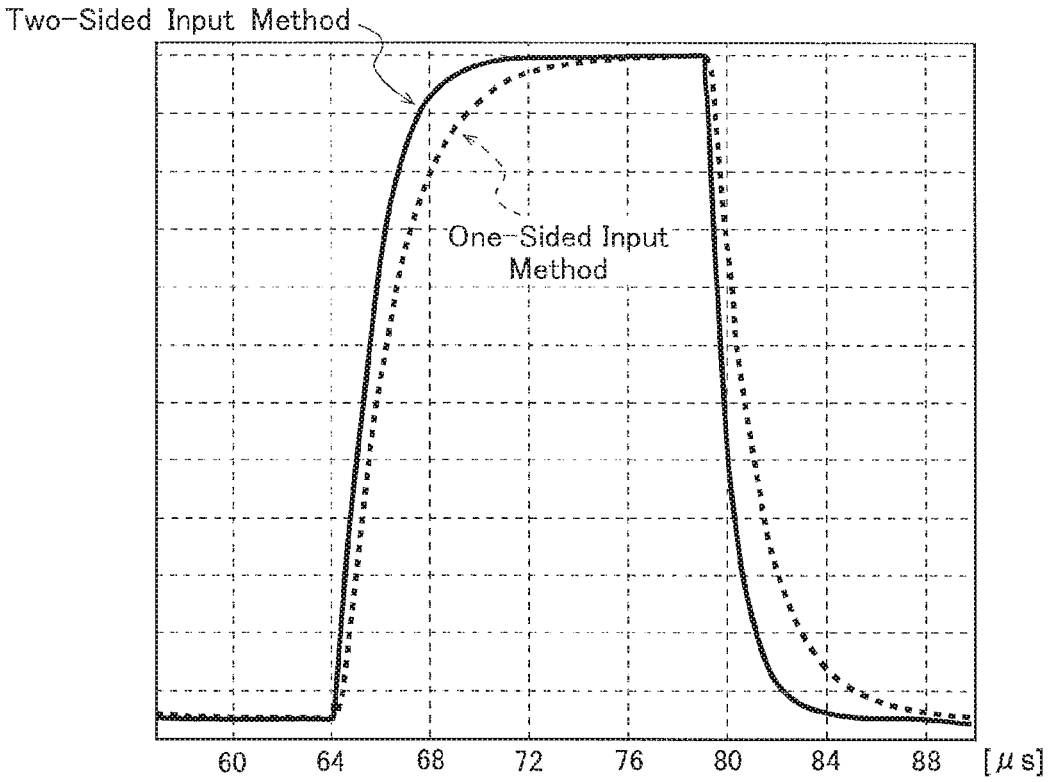
FIG. 12 is a diagram showing pulse waveforms of scanning signals output from the gate drivers of the two-sided input method and the one-sided input method.

However, in the one-sided input method, the waveform blunting of the scanning signal is large as compared to that in the two-sided input method. That is, assuming that a resistance value is Rg and a capacitance value is Cg when one gate bus line is taken as a resistor-capacitor (RC) circuit, in the two-sided input method, a substantial time constant of one gate bus line is (Rg/2)(Cg/2)=Rg·Cg/4, whereas in the one-sided input method, a time constant of one gate bus line is Rg·Cg. As described above, the time constant of one gate bus line in the case of the one-sided input method is substantially four times larger than that in the case of the two-sided input method. Accordingly, for example as shown in FIG. 12, the waveform blunting of the scanning signal in the one-sided input method is large as compared to that in the two-sided input method. When the blunting of the falling waveform of the scanning signal becomes large, it becomes difficult to speed up the scanning of the gate bus line in the display unit, and hence it can be generally said that the one-sided input method is not suitable for a display device requiring high-speed scanning (a display device with a high frame frequency or a display device with high resolution).

In contrast, in the gate driver in the present embodiment, as shown in FIG. 5, the one-sided input method has been adopted, but for each gate bus line GLi (i=1 to N), the unit main circuit 41*m* and the unit sub-circuit 42*s* or the unit main circuit 42*m* and the unit sub-circuit 41*s* are provided, and as shown in FIG. 10, at the time of changing the gate bus line GLi in the selected state to the non-selected state, the transistor M13L as the inactivation switching element and the transistor M13R as the inactivation auxiliary switching element are turned on. Thereby, the charges accumulated in the gate bus line GLi in the selected state are released from both ends of the gate bus line GLi. As a result, the blunting of the falling waveform of the scanning signal is prevented to shorten the fall time.

Figure 13:
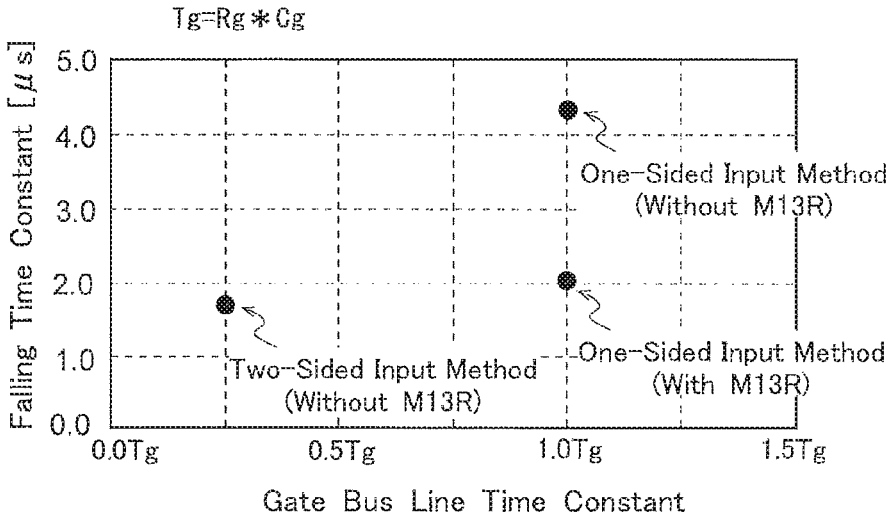
FIG. 13 is a diagram showing the relationship among the input method and the discharge form of the scanning signal to the gate bus line, a gate bus line time constant, and a falling time constant of the scanning signal.

As described above, in the normal one-sided input method, the waveform blunting of the scanning signal is large and the fall time is long as compared to the two-sided input method. However, in the present embodiment, while the one-sided input method has been adopted, the inactivation auxiliary switching element is provided, so that the fall time of the scanning signal is shortened as compared to that in the normal one-sided input method. That is, as shown in FIG. 13, the gate bus line time constant in the case of the one-sided input method is four times larger than the gate bus line time constant in the case of the two-sided input method. As a result, in the configuration in which the transistor M13R as the inactivation auxiliary switching element is not provided in the one-sided input method, the time required for the value of the scanning signal to change from the maximum value to 1/e times of the maximum value at the fall time of the scanning signal (hereinafter referred to as "falling time constant") is more than double the falling time constant in the two-sided input method. However, in the present embodiment, since the transistor M13R as the inactivation auxiliary switching element is provided at the other end of each gate bus line GLi while the one-sided input method has been adopted (see FIGS. 5 and 10), the falling time constant is about the same as in the case of the two-sided input method.

Figure 14:
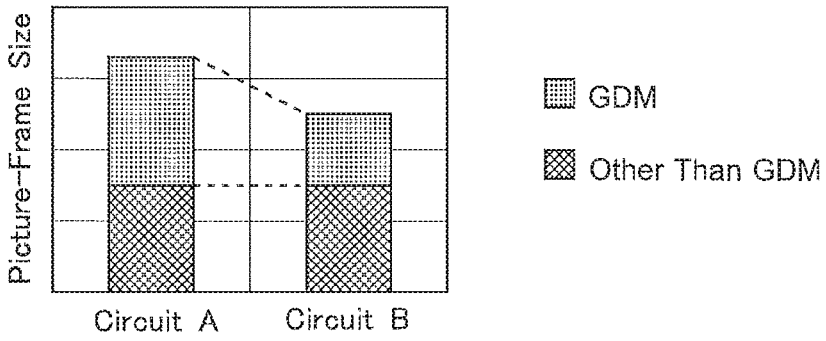
FIG. 14 is a diagram for explaining the effect of reduction in picture-frame size in the embodiment.

FIG. 14 is a diagram for explaining the effect of reducing the picture-frame size in the present embodiment, and shows a result of trial calculation of the picture-frame size for a 13.3-inch full high definition (FHD) liquid crystal panel. That is, FIG. 14 shows picture-frame sizes of a circuit A and a circuit B. The circuit A is a comparative example and a circuit of a monolithic gate driver in which the AC buffer method and the two-sided input method have been adopted, and the circuit B is a circuit corresponding to the present embodiment and is a circuit of a monolithic gate driver in which the DC buffer method and the one-sided input method have been adopted (see FIGS. 4 and 5). Note that "other than GDM" in FIG. 14 is a portion not related to the circuit of the monolithic gate driver and includes trunk wiring and a margin for division, and the size other than this GDM is the same between the circuit A and the circuit B. "GDM" in FIG. 14 is a portion corresponding to the circuit of the monolithic gate driver and includes a logic circuit portion and trunk wiring used therein.

According to the trial calculation shown in FIG. 14 for the 13.3-inch FHD liquid crystal panel, by adopting the configuration of the present embodiment, the size of the GDM portion is reduced by 45.4%, and the size of the picture-frame region as a whole is reduced by 25.2%. Also, for the power consumption, by applying the configuration of the present embodiment, a result of trial calculation that the GDM portion is reduced by 37.8% has been obtained.

As described above, according to the present embodiment, since the DC buffer method has been adopted in the gate driver, it is possible to reduce the power consumption without increasing the number of phases of the clock signal. That is, it is possible to narrow the picture-frame of the liquid crystal panel while reducing the power consumption. Further, in the gate driver, the inactivation auxiliary switching element (M13R) is provided at the other end of each gate bus line GLi while the one-sided input method is adopted, it is possible to reduce the area of the picture-frame region while preventing the blunting of the falling waveform of the scanning signal. In this manner, according to the present embodiment, by the combination of adoption of the DC buffer method and adoption of the one-sided input method with the inactivation auxiliary switching element, it is possible to reduce the power consumption and narrow the picture-frame of the liquid crystal panel while ensuring high-speed scanning capacity for image display in the gate driver.

4. Modified Examples

The present invention is not limited to the above embodiment, but a variety of modification may be made so long as not deviating from the scope of the present invention.

For example, the specific configurations of the unit main circuits 41*m*, 42*m* and the unit sub-circuits 41*s*, 42*s* in the first and second gate drivers 410, 420 are not limited to the configurations shown in FIGS. 4 and 5. Other configurations may be adopted so long as being configurations based on the DC buffer method and the one-sided input method with the inactivation auxiliary switching element. In addition, the transistors as the constituent elements of the first and second gate drivers 410, 420 and the pixel formation portion Ps in the above embodiment have been described taking the example of using the N-channel thin film transistors, but the present invention is not limited thereto, and P-channel type thin film transistors may be used.

In the above embodiment, the six-phase clock signal has been used as the clock signal for operating the gate drivers (the first and second gate drivers 410, 420), the six-phase clock signal having a duty ratio of 50% and being made up of the first to sixth gate clock signals GCK1 to GCK6. However, the clock signal for operating the gate driver in the present invention is not limited to such a six-phase clock signal. For example, instead of such a six-phase clock signal, an 8-phase clock signal with a duty ratio of ⅜ may be used. In general, a y-phase clock signal having a duty ratio of x/y that satisfies the following conditions (1) to (3) can be used as the clock signal for operating the gate driver in the present invention.

(1) y is an even number equal to or greater than 6.

(2) x is an odd number equal to or greater than 3 or more.

(3) $x/y \leq 1/2$

In the configuration using the y-phase clock signal having the duty ratio of x/y that satisfies the above conditions (1) to (3), the change timing of one of the clock signals input into the first gate driver 410 and the change timing of one of the clock signals input into the second gate driver 420 coincide with each other (in the example shown in FIG. 6, for example, the falling timing of the first gate clock signal GCK1 coincides with the rising timing of the fourth gate clock signal GCK4). From this fact, in order that the inactivation switching element (transistor M13L) and the inactivation auxiliary switching element (transistor M13R), which are respectively connected to one end and the other end of each scanning signal line, are simultaneously changed to the on-state, the control signal for the inactivation switching element and the inactivation auxiliary switching element in the first gate driver 410 can be generated in the first gate driver 410, and the control signal for the inactivation switching element and the inactivation auxiliary switching element in the second gate driver 420 can be generated in the second gate driver 420.

In the above description, the liquid crystal display device has been described as the example of the embodiment, but the present invention is not limited thereto, and can be applied to other types of display devices such as an organic electroluminescence (EL) display device so long as being a matrix type display device.

What is claimed is:

1. A scanning signal line drive circuit that selectively drives a plurality of scanning signal lines provided on a display unit of a display device, the scanning signal line drive circuit comprising:

a first scanning signal line drive unit disposed on one end side of the plurality of scanning signal lines;

a second scanning signal line drive unit disposed on the other end side of the plurality of scanning signal lines;

a first power supply line configured to supply a fixed voltage to be applied to a scanning signal line to be brought into a selected state; and a second power supply line configured to supply a fixed voltage to be applied to the scanning signal line to be brought into a non-selected state, wherein the first scanning signal line drive unit includes a first activation switching element that is provided for each of odd-numbered scanning signal lines in the plurality of scanning signal lines, is in an on-state while the scanning signal line is to be in a selected state, and is in an off-state while the scanning signal line is to be in a non-selected state, a first inactivation switching element that is provided for each of the odd-numbered scanning signal lines in the plurality of scanning signal lines, is in the off-state while the scanning signal line is to be in the selected state, and is in the on-state while the scanning signal line is to be in the non-selected state, and a first inactivation auxiliary switching element that is provided for each of even-numbered scanning signal lines in the plurality of scanning signal lines, is in the off-state while the scanning signal line is to be in the selected state, and is in the on-state while the scanning signal line is to be in the non-selected state, the second scanning signal line drive unit includes a second activation switching element that is provided for each of the even-numbered scanning signal lines in the plurality of scanning signal lines, is in the on-state while the scanning signal line is to be in the selected state, and is in the off-state while the scanning signal line is to be in the non-selected state, a second inactivation switching element that is provided for each of the even-numbered scanning signal lines in the plurality of scanning signal lines, is in the off-state while the scanning signal line is to be in the selected state, and is in the on-state while the scanning signal line is to be in the non-selected state, and a second inactivation auxiliary switching element that is provided for each of odd-numbered scanning signal lines in the plurality of scanning signal lines, is in the off-state while the scanning signal line is to be in the selected state, and is in the on-state while the scanning signal line is to be in the non-selected state, each of the odd-numbered scanning signal lines in the plurality of scanning signal lines is connected to the first power supply line via the first activation switching element, is connected to the second power supply line via the first inactivation switching element, and is connected to the second power supply line via the second inactivation auxiliary switching element, and each of the even-numbered scanning signal lines in the plurality of scanning signal lines is connected to the first power supply line via the second activation switching element, is connected to the second power supply line via the second inactivation switching element, and is connected to the second power supply line via the first inactivation auxiliary switching element.

2. The scanning signal line drive circuit according to claim 1, wherein the first scanning signal line drive unit includes a plurality of first bistable circuits that are cascade-connected to each other to constitute shift registers and correspond one-to-one with the odd-numbered scanning signal lines in the plurality of scanning signal lines, the second scanning signal line drive unit includes a plurality of second bistable circuits that are cascade-connected to each other to constitute shift registers and correspond one-to-one with the even-numbered scanning signal lines in the plurality of scanning signal lines, the first and second scanning signal line drive units receive a multiphase clock signal, cause the plurality of first bistable circuits for operating as the shift registers in the first scanning signal line drive unit to control ON/OFF of the first activation switching element, the first inactivation switching element, and the first inactivation auxiliary switching element, and cause the plurality of second bistable circuits for operating as the shift registers in the second scanning signal line drive unit to control ON/OFF of the second activation switching element, the second inactivation switching element, and the second inactivation auxiliary switching element.

3. The scanning signal line drive circuit according to claim 2, wherein y is an even number equal to or greater than 6, x is an odd number equal to or greater than 3, and x/y is equal to or smaller than 1/2, where y is the number of phases of the multiphase clock signal and x/y is a duty ratio.

4. The scanning signal line drive circuit according to claim 3, wherein the multiphase clock signal is a six-phase clock signal and is made up of first to sixth clock signals with sequentially different phases, the first scanning signal line drive unit operates the plurality of first bistable circuits as a shift register in accordance with the first, third, and fifth clock signals, to sequentially bring the odd-numbered scanning signal lines in the plurality of scanning signal lines into the selected state for each predetermined period, and sequentially bring the even-numbered scanning signal lines in the selected state brought by the second scanning signal line drive unit into the non-selected state, the second scanning signal line drive unit operates the plurality of second bistable circuits as a shift register in accordance with the second, fourth, and sixth clock signals, to sequentially bring the even-numbered scanning signal lines in the plurality of scanning signal lines into the selected state, and sequentially bring the odd-numbered scanning signal lines in the selected state brought by the first scanning signal line drive unit into the non-selected state.

5. The scanning signal line drive circuit according to claim 3, wherein, an output signal of a first bistable circuit subsequent to a first bistable circuit corresponding to a scanning signal line that follows the scanning signal line corresponding to each of the first inactivation auxiliary switching elements is applied to a control terminal of the relevant first inactivation auxiliary switching element in the first scanning signal line drive unit, an output signal of a second bistable circuit subsequent to a second bistable circuit corresponding to a scanning signal line that follows the scanning signal line corresponding to each of the second inactivation auxiliary switching elements is applied to a control terminal of the relevant second inactivation auxiliary switching element in the second scanning signal line drive unit, the first scanning signal line drive unit includes a first timing adjustment circuit configured to generate a control signal of the first inactivation switching element so that for each of the odd-numbered scanning signal lines in the plurality of scanning signal lines, the first inactivation switching element and the second inactivation auxiliary switching element corresponding to the relevant scanning signal line simultaneously change from the off-state to the on-state, based on the output signal of the first bistable circuit subsequent to the corresponding first bistable circuit and a clock signal to be input into the corresponding first bistable circuit, and the second scanning signal line drive unit includes a second timing adjustment circuit configured to generate a control signal of the second inactivation switching element so that for each of the even-numbered scanning signal lines in the plurality of scanning signal lines, the second inactivation switching element and the first inactivation auxiliary switching element corresponding to the relevant scanning signal line simultaneously change from the off-state to the on-state, based on the output signal of the second bistable circuit subsequent to the corresponding second bistable circuit and a clock signal to be input into the corresponding second bistable circuit.

6. The scanning signal line drive circuit according to claim 1, wherein switching elements in the first scanning signal line drive unit and the second scanning signal line drive unit are thin film transistors in each of which a channel layer is formed of an oxide semiconductor.

7. A display device provided with a display unit including a plurality of data signal lines, a plurality of scanning signal lines intersecting the plurality of data signal lines, and a plurality of pixel formation portions arranged in a matrix along the plurality of data signal lines and the plurality of scanning signal lines, the display device comprising:

a data signal line drive circuit configured to drive the data signal lines, the scanning signal line drive circuit according to claim 1, configured to drive the plurality of scanning signal lines so that the plurality of scanning signal lines sequentially come into a selected state, wherein the scanning signal line drive circuit and the display unit are integrally formed on the same substrate.

8. A driving method for selectively driving a plurality of scanning signal lines provided on a display unit of a display device, the driving method comprising:

a first scanning signal line driving step of driving the plurality of scanning signal lines on one end side of the plurality of scanning signal lines by a first scanning signal line drive unit connected to each of the plurality of scanning signal lines; and a second scanning signal line driving step of driving the plurality of scanning signal lines on the other end side of the plurality of scanning signal lines by a second scanning signal line drive unit connected to each of the plurality of scanning signal lines, wherein the first scanning signal line driving step includes a step of connecting each of odd-numbered scanning signal lines in the plurality of scanning signal lines to a first power supply line that supplies a fixed voltage to be applied to a scanning signal line to be brought into a selected state while the scanning signal line is to be in the selected state, a step of connecting each of the odd-numbered scanning signal lines in the plurality of scanning signal lines to a second power supply line that supplies a fixed voltage to be applied to a scanning signal line to be brought into a non-selected state when the scanning signal line is to be brought into the non-selected state, and a step of connecting each of even-numbered scanning signal lines in the plurality of scanning signal lines to the second power supply line when the scanning signal line is to be brought into the non-selected state, and the second scanning signal line driving step includes a step of connecting each of the even-numbered scanning signal lines in the plurality of scanning signal lines to the first power supply line while the scanning signal line is to be in the selected state, a step of connecting each of the even-numbered scanning signal lines in the plurality of scanning signal lines to the second power supply line when the scanning signal line is to be brought into the non-selected state, and a step of connecting each of the odd-numbered scanning signal lines in the plurality of scanning signal lines to the second power supply line when the scanning signal line is to be brought into the non-selected state.

* * * * *